US006835097B2

(12) United States Patent
Nankou et al.

(10) Patent No.: US 6,835,097 B2
(45) Date of Patent: Dec. 28, 2004

(54) CONNECTOR

(75) Inventors: Yuuichi Nankou, Yokkaichi (JP); Hajime Kawase, Yokkaichi (JP); Ryotaro Ishikawa, Yokkaichi (JP); Naoya Kurimoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 6 days.

(21) Appl. No.: 10/449,463

(22) Filed: May 29, 2003

(65) Prior Publication Data

US 2004/0005821 A1 Jan. 8, 2004

(30) Foreign Application Priority Data

Jul. 4, 2002 (JP) ..... 2002-196441

(51) Int. Cl.[7] ..... H01R 13/422
(52) U.S. Cl. ..... 439/595
(58) Field of Search ..... 439/595, 752

(56) References Cited

U.S. PATENT DOCUMENTS 5,575,684 A 11/1996 Uchida et al.
6,149,462 A * 11/2000 Sugie ..... 439/595
6,341,985 B2 * 1/2002 Kodama ..... 439/595
6,488,536 B2 * 12/2002 Fukamachi ..... 439/595
6,533,615 B2 * 3/2003 Koide et al. ..... 439/610
6,547,594 B2 * 4/2003 Ichio et al. ..... 439/595
6,575,788 B2 * 6/2003 Nimura et al. ..... 439/595
6,582,242 B2 * 6/2003 Murakami et al. ..... 439/271
6,589,083 B2 * 7/2003 Kobayashi et al. ..... 439/752
6,592,411 B2 * 7/2003 Mase et al. ..... 439/752
6,602,098 B2 * 8/2003 Sugie et al. ..... 439/752

FOREIGN PATENT DOCUMENTS

EP 1 209 766 A2 5/2002
JP 6-325814 11/1994

* cited by examiner

*Primary Examiner*—Gary Paumen
(74) *Attorney, Agent, or Firm*—Gerald E. Hespos; Anthony J. Casella

(57) ABSTRACT

A female housing is provided with cavities (41) into which terminal fittings are insertable, and locks (43) provided in the cavities (41) and resiliently engageable with the terminal fittings being inserted to lock the terminal fittings. Openings (64) formed by removing a mold for forming locking surfaces (58) of the locks (43) engageable with the female terminals are so formed in the female housing as to be open forward. Each lock (43) is supported at both front and rear ends, and a section thereof projecting more forward than the locking surface (58) is connected with side surfaces (**64*b*, 64*c*) of the circumferential surfaces of the corresponding opening (64) extending along a deforming direction of the lock (43**).

9 Claims, 26 Drawing Sheets

CONNECTOR

BACKGROUND OF THE INVENTION

1. Field of the Invention

The present invention relates to a connector.

2. Description of the Related Art

Japanese Unexamined Patent Publication No. 6-325814 and FIG. 26 herein show a connector with locks for locking terminal fittings. With reference to FIG. 26, the connector has a housing 1 and terminal fittings 2 are inserted from behind into cavities 3 in the housing 1. Deformation permitting spaces 4 are formed in the housing 1 above the cavities 3 and resin locks 5 are cantilevered between the cavities 3 and the deformation permitting spaces 4. Each lock 5 has a forwardly cantilevered arm 6 and a locking projection 7 that projects into the cavity 3 from the inner surface of the arm 6 for engaging the terminal fitting 2. The terminal fittings 2 are configured to deform the locks 5 as the terminal fittings 2 are inserted into the cavities 3. The locks 5 then are restored resiliently so that the locking projection 7 engages the terminal fitting 2 when the terminal fitting 2 reaches a proper depth. Further, a projection 8 extends forward from the leading end of the arm 6 and is used to disengage the lock 5 from the terminal fitting 2.

A demand exists for the miniaturization of connectors. Accordingly, consideration has been given to reducing the thickness of the arms 6 of the lock 5. However, the arms 6 are supported only at one end, and a specified thickness is required to obtain a necessary strength. Thus, there has been a limit in miniaturizing the connector by thinning the arms 6.

The present invention was developed in view of the above problem and an object thereof is to provide a connector suited to being miniaturized.

SUMMARY OF THE INVENTION

The invention relates to a connector with a housing that has cavities into which terminal fittings are insertable. A lock is provided in each cavity and is resiliently engageable with the terminal fitting as the terminal fitting is inserted to lock the terminal fitting in the cavity. The lock is supported at both ends and comprises a locking surface for locking the terminal fitting. The housing is formed with an opening that opens forward and preferably is created during the formation of the locking surface on the lock. A section of the lock forward of the locking surface is connected with at least one side surface of the opening. Thus, a high strength for the lock can be maintained even if the thickness is reduced as compared to conventional cantilevered locks. Accordingly, a force to lock the terminal fitting can be enhanced, and the connector is suited to being miniaturized.

The section of the lock that is connected with the side surface of the opening does not hinder the formation of the locking surface, and enables the locking surface to be wider. Thus, even if the connector is miniaturized, a sufficient locking force can be secured for the terminal fitting.

The side surface of the opening that is connected with the lock extends substantially along the deforming direction of the lock. Thus, the connection does not hinder the formation of the locking surface, and enables the locking surface to be wider. Accordingly, a sufficient locking force can be secured for the terminal fitting even if the connector is miniaturized.

The section of the lock forward of the locking surface preferably is connected with a pair of opposed facing side surfaces of the opening.

The locking surface can be substantially as wide as the lock. Thus, the force to lock the terminal fitting can be enhanced.

The section of the lock forward of the locking surface that is connected with the side surface of the opening also may be connected with a surface of the opening adjacent to the side surface.

The section of the lock that projects more forward than the locking surface preferably has a forwardly open maneuverable groove. The terminal fitting can be detached from the cavity by inserting a disengagement jig into the opening and against a surface of the maneuverable groove to deform the lock. The terminal fitting then can be pulled back and away from the lock.

A lock projection preferably projects from the terminal fitting and is insertable into the maneuverable groove. Additionally, the locking surface preferably is to the rear end of the maneuverable groove so that the extended portion of the locking surface can engage the locking projection for locking. The engagement of the extended portion of the locking surface with the locking projection enhances the locking force on the terminal fitting.

A jig-introducing groove is formed at the section of the lock that projects more forward than the locking surface. The jig-introducing groove communicates with the maneuverable groove and divides the section of the lock forward of the locking surface. Thus, a large entrance is provided for the disengagement jig.

The lock preferably is separated over at least part of its longitudinal extension from sidewalls of the cavity by at least one recess.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A first embodiment of a female connector according to the invention is described with reference to FIGS. 1 to 15. The female connector includes a female housing 40 into which female terminal fittings 30 are insertable. The female housing 40 is configured to connect with a male housing so that the female terminal fittings 10 are electrically connectable with male terminal fittings in the male housing (neither male terminal fittings nor male housing is shown). In the following description, directions of inserting and withdrawing the female terminal fittings 10 into and from the female housing 40 are referred to as a forward direction and a backward direction, respectively, and reference is made to FIG. 7 concerning the vertical direction.

Figure 4:
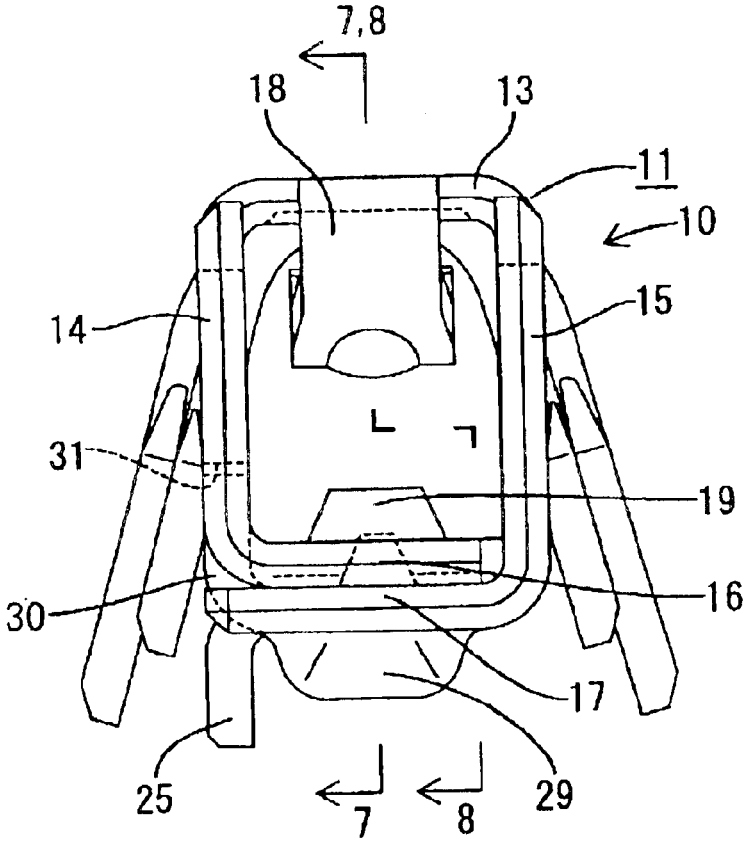
FIG. 4 is a front view of a female terminal fitting.
Figure 5:
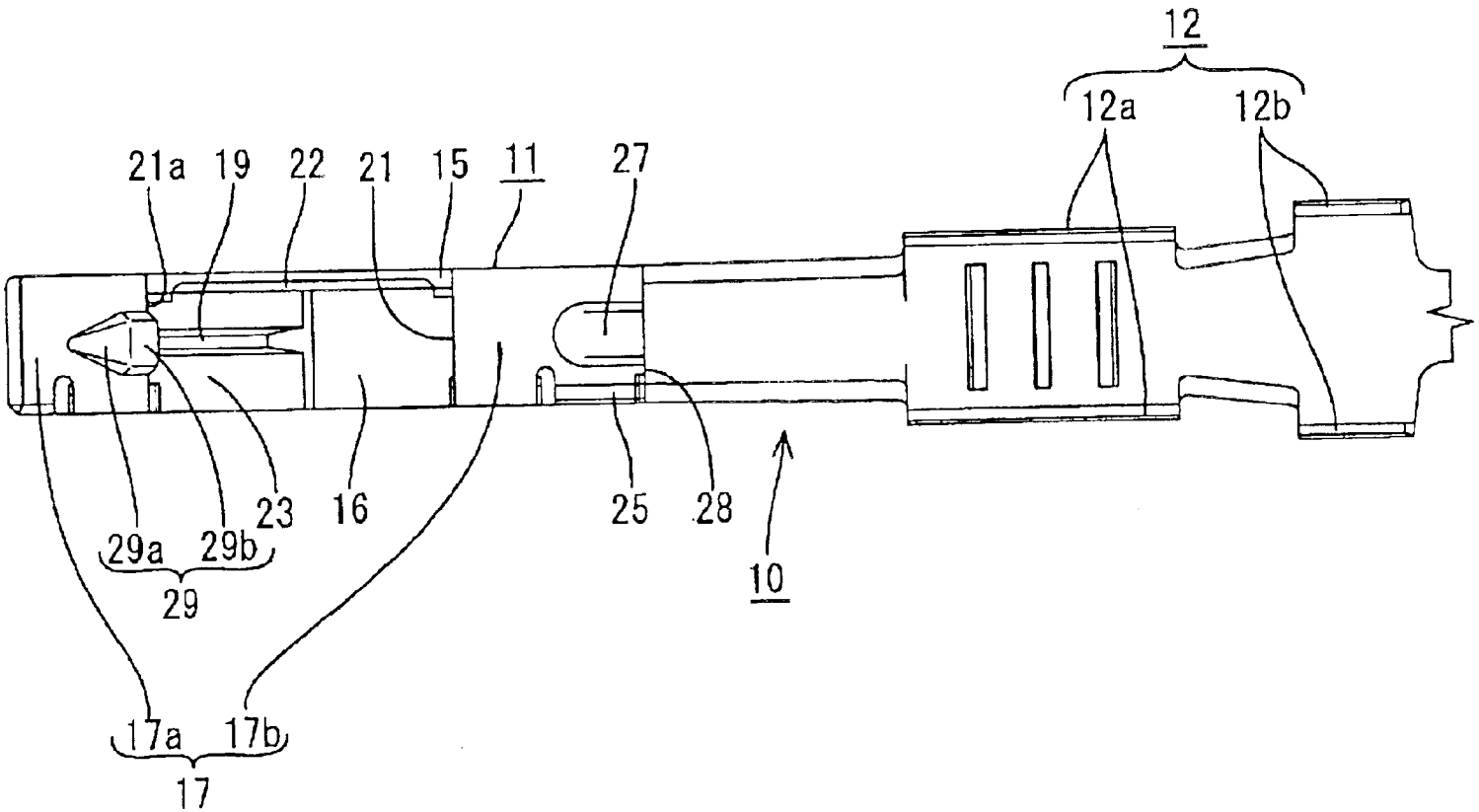
FIG. 5 is a bottom view of the female terminal fitting.

The female terminal fitting 10 is formed by embossing, folding and/or bending a metallic material stamped or cut into a specified shape. As a result, the female terminal fitting 10 has a substantially box-shaped main body 11 with open front and rear ends, as shown in FIGS. 4 and 5. A barrel 12 extends from the rear end of the main body 11. The barrel 12 has front crimping pieces 12*a* for connection with a core Wa of the wire W, and rear crimping pieces 12*b* for connection with an insulated portion Wb of the wire W.

The main body 11 has a ceiling wall 13 that extends forward and back, side walls 14, 15 that extend down from lateral edges of the ceiling wall 13, a bottom wall 16 that projects from a projecting end of the left side wall 14 of FIG. 4 to face the ceiling wall 13, and an outer wall 17 that projects from a projecting end of the right side wall 14 of FIG. 4 to lie outside of the bottom wall 16.

Figure 7:
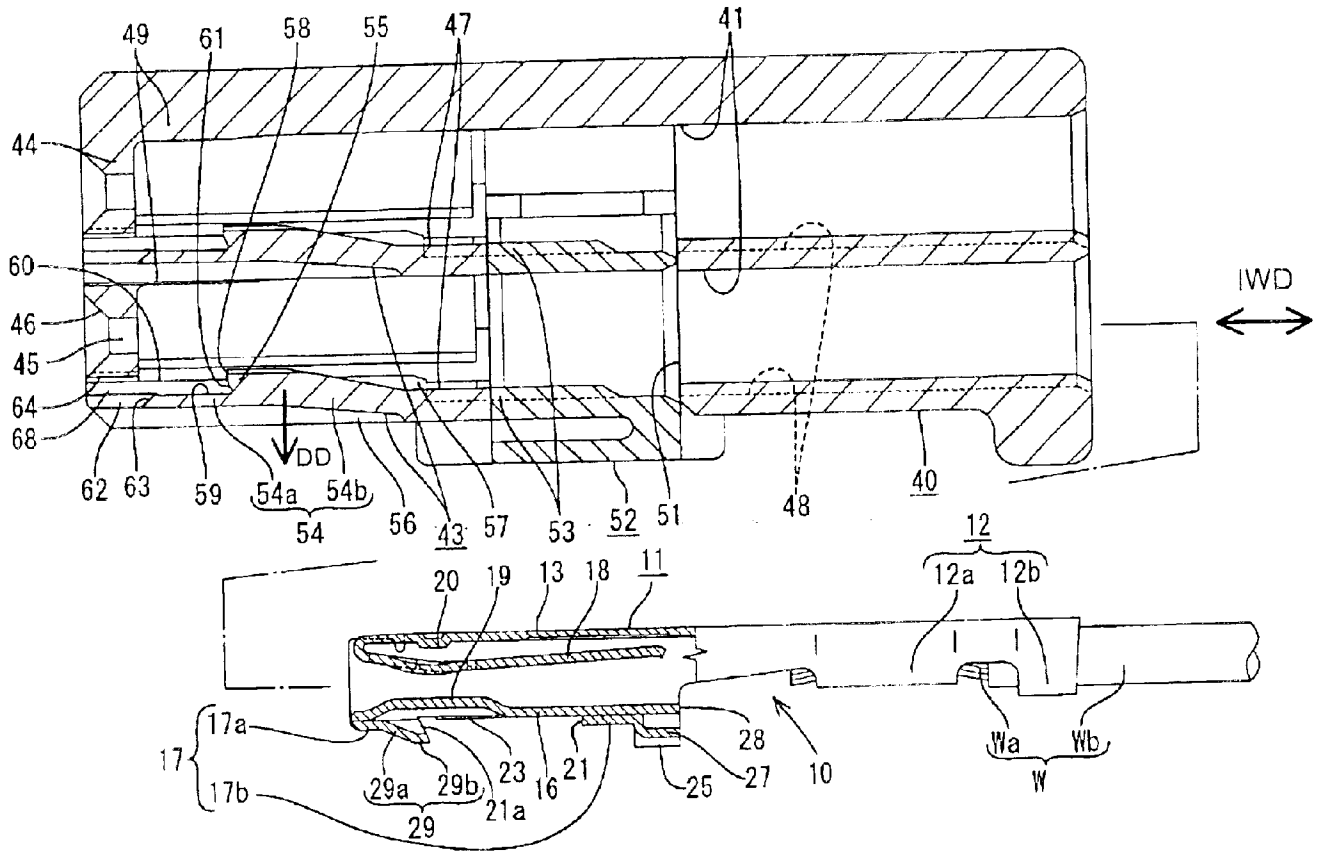
FIG. 7 is a side view in section (the female housing is shown by a section along 7—7 of FIG. 1 and the female terminal fitting is shown by a section along 7—7 of FIG. 4) showing a state before the female terminal fitting is inserted into the female housing with a retainer mounted at a partial locking position.

The front end of the ceiling wall 13 is retracted back from the front ends of the other walls 14, 15, 16 and 17, and a resilient contact piece 18 projects from the front end of the ceiling wall 13, as shown in FIG. 7. The resilient contact piece 18 is supported only at one end and has a bent or pointed shape by folding a tongue piece that projects forward from the front end of the ceiling wall 13. The resilient contact piece 18 can resiliently contact a tab of a mating male terminal fitting inserted into the main body 11 from the front. A receiving portion 19 projects in from the bottom wall 16 and substantially faces the resilient contact piece 18. The receiving portion 19 cooperates with the resilient contact piece 18 to hold or squeeze the tab. Further, a portion of the ceiling wall 13 is embossed to project in, thereby forming an excessive deformation preventing projection 20 for engaging the resilient contact piece 18 before the resilient contact piece 18 deforms beyond its resiliency limit.

Figure 8:
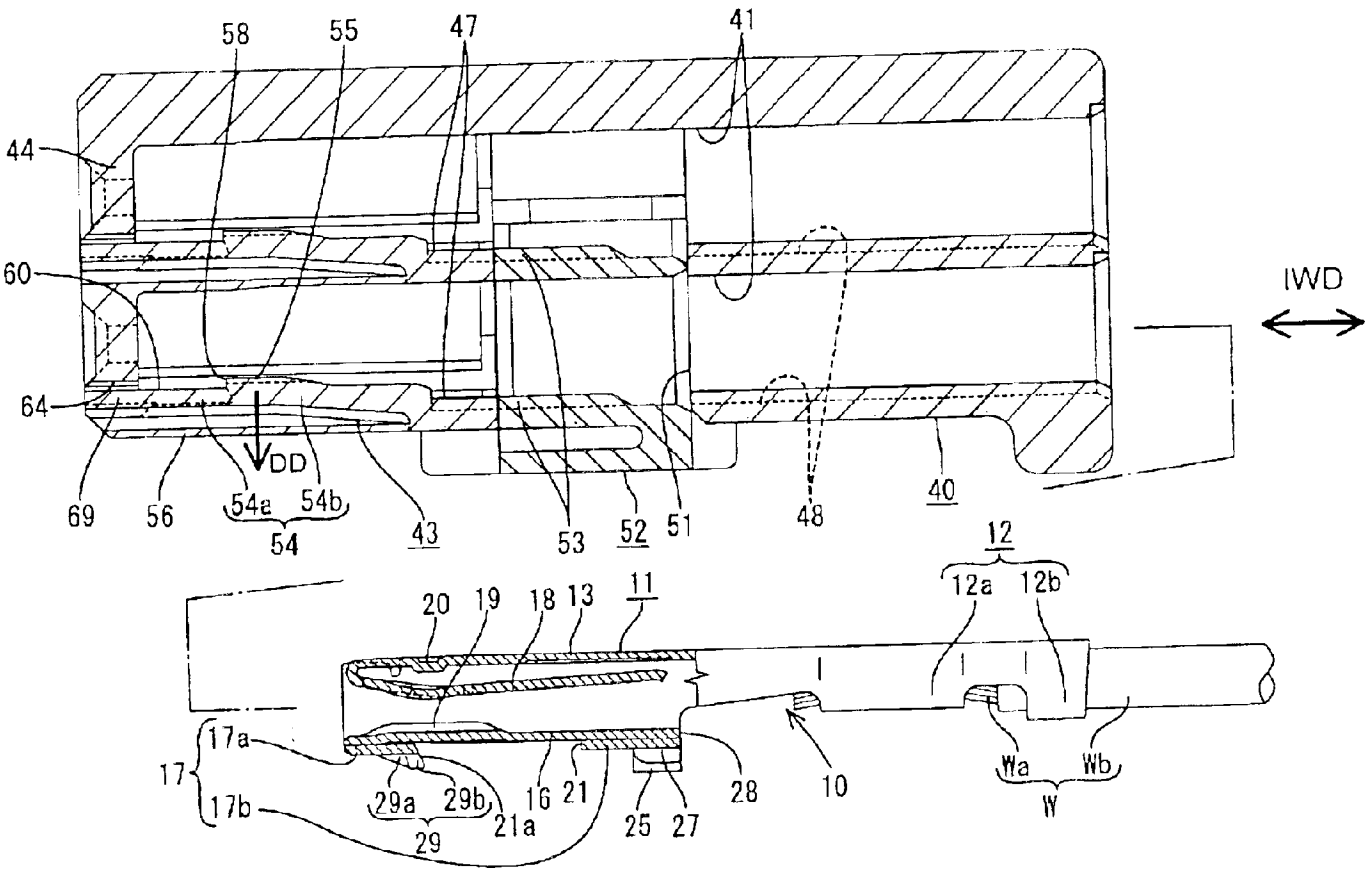
FIG. 8 is a side view in section (the female housing is shown by a section along 8—8 of FIG. 1 and the female terminal fitting is shown by a section along 8—8 of FIG. 4) showing the state before the female terminal fitting is inserted into the female housing with the retainer at the partial locking position.

The outer wall 17 is divided into a front portion 17*a* and a rear portion 17*b* by a cut-away portion 21 formed over substantially the entire width at a substantially longitudinal middle, as shown in FIGS. 5 and 8. The front cut end surface 21*a* of the cut-away portion 21 serves as a locking surface and is inclined in and up to the back over its entire area. The cut-away portion 21 has a length slightly less than half the length of the outer wall 17 and extends up to the bottom end of the sidewall 15 at the upper side in FIG. 5. A bulging piece 22 projects from the projecting end of the bottom wall 16 and contacts the bottom end surface of the side wall 15 to hold the bottom wall 16 substantially horizontal. The entire bottom wall 16, except a contact portion of the bulging piece 22 with the sidewall 15, is slightly lower than this contact portion, thereby increasing a depth of engagement with the lock 13. The front portion 17*a* of the outer wall 17 is slightly shorter than the rear portion 17*b* in forward and backward directions.

Figure 6:
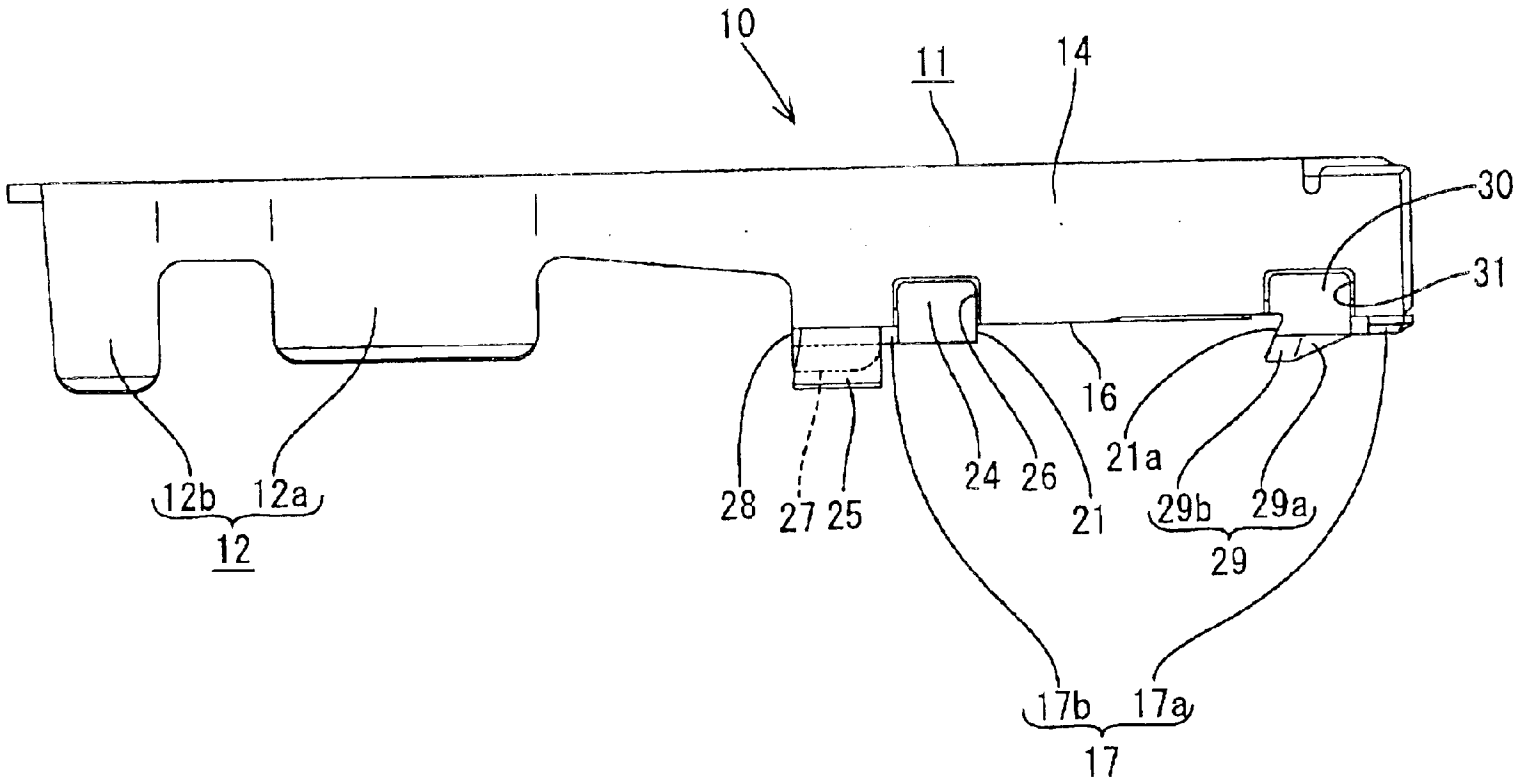
FIG. 6 is a left side view of the female terminal fitting.

A rear-portion holding piece 24 and a stabilizer 25 are provided one after the other at the projecting end of the rear portion 17*b* of the outer wall 17, as shown in FIG. 6. The rear-portion holding piece 24 is bent in toward the ceiling wall 13 and the stabilizer 25 is bent out. The rear-portion holding piece 24 fits in a rear-portion holding groove 26 in the side wall 14, as shown in FIG. 6, and hence prevents the rear portion 17*b* from making loose forward and backward movements along the longitudinal direction of the terminal fitting 10. The front end of the rear-portion holding piece 24 substantially aligns with the front end of the rear portion 17*b*, whereas the rear end of the stabilizer 25 substantially aligns with the rear end of the rear portion 17*b*. A projection 27 is embossed out from a widthwise center of the rear end of the rear portion 37*b* and has a length substantially equal to the length of the stabilizer 25.

A locking projection 29 is embossed to project out at a position slightly displaced to the left side of FIG. 4 from the center of the rear end of the front portion 17*a* of the outer wall 17, and hence at the front cut end of the cut-away portion 21. The locking projection 29, as shown in FIGS. 5 to 7, has a pyramid portion 29*a* formed by three slanted surfaces and a substantially rectangular tube portion 29*b* with a substantially constant width and height formed by three side surfaces connected one after the other. The pyramid portion 29*a* of the locking projection 29 is tapered so that the width and height of the locking projection 29 gradually decrease toward the front. The front end of the pyramid portion 29*a* defines a slightly rounded vertex. The substantially rectangular tube portion 29*b* of the locking projection 29 overhangs backward substantially along the inclination of the front cut end surface 21*a* of the cut-away portion 21 and projects more back towards the cut-away portion 21 than the front portion 17*a* of the outer wall 17. Thus, the locking projection 29 is substantially parallel to the front cut end surface 21*a,* which is tapered to incline inwardly at an angle $\alpha$ with respect to the insertion and withdrawal directions IWD, see FIG. 6.

The locking projection 29 projects up to substantially the same height as the projection 27, and the rear end 29*c* of the locking projection 29 defines a locking surface. More particularly, the rear end 29*c* is formed by the front cut end surface 17*a* of the cut-away portion 17 and inclines in and up to the back. The rear end surfaces of the front portion 17*a* of the outer wall 17 at the opposite sides of the locking projection 29 also are formed by the front cut end surface 21*a* of the cut-away portion 21 inclined in and up to the back.

A front-portion holding piece 30 is provided at the projecting end of the front portion 17*a* of the outer wall 17 and is bent toward the ceiling wall 13, as shown in FIG. 6. The front-portion holding piece 30 is fit into a front-portion holding groove 31 formed in the side wall 14, as shown in FIG. 6, to hold the front portion 17*a* and to prevent the front portion 17*a* from making loose forward and backward movements. The front-portion holding piece 30 projects more backward than the front portion 17*a* of the outer wall 17. The cut-away portion 21 extends into the base end of the front-portion holding piece 30, and the cut end surface 21*a* thereof is inclined up to the back, as already described.

Figure 1:
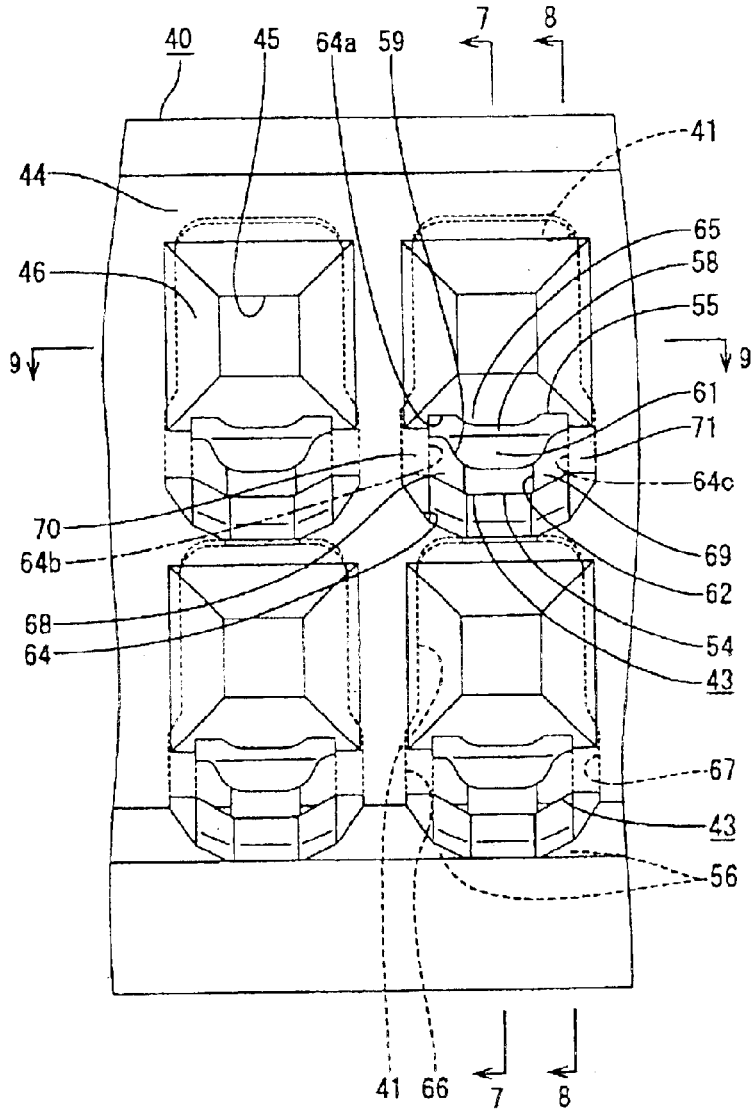
FIG. 1 is a front view of a female housing according to a first embodiment of the invention.
Figure 2:
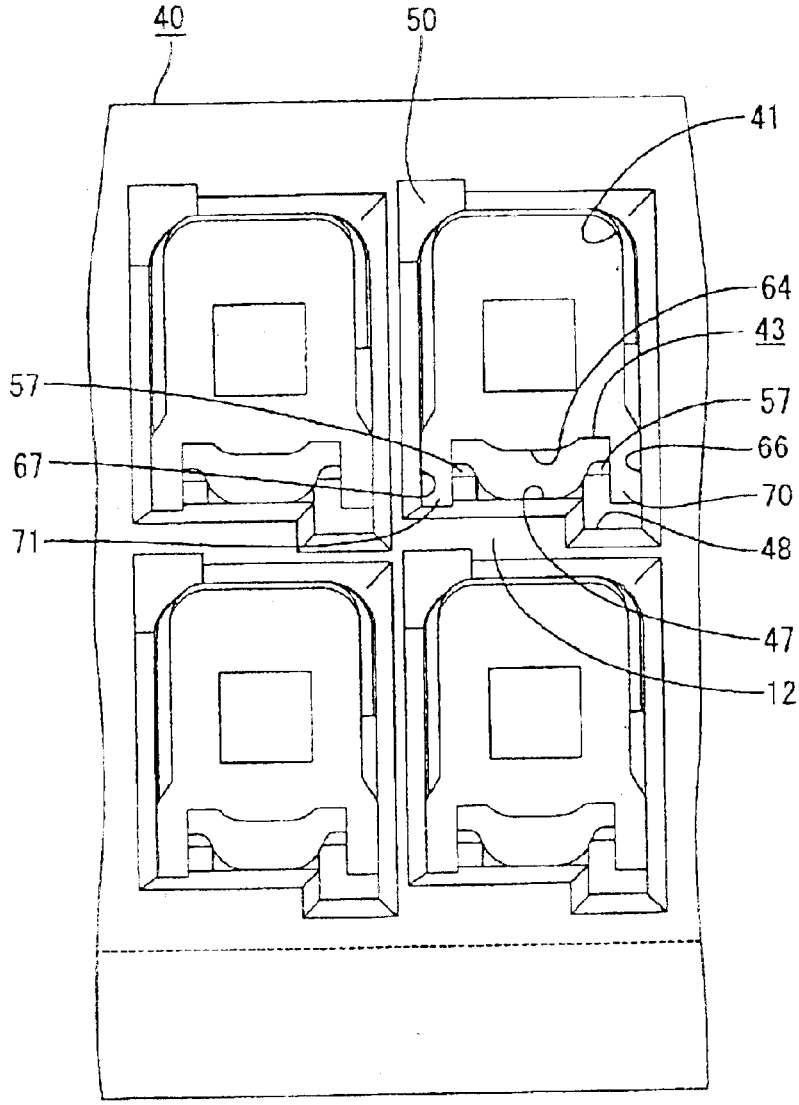
FIG. 2 is a rear view of the female housing.

The female housing 40 is molded e.g. of a synthetic resin, and a plurality of cavities 41 are arranged substantially side by side along a widthwise direction at two stages, as shown in FIGS. 1, 2 and 7. Each cavity 41 has a bottom wall 42 and a resilient lock 43 projects from the bottom wall 42. The female terminal fittings 10 can be inserted into the cavities 41 from behind and locked by the locks 43. The female housing 40 also has a front wall 44 for supporting the female terminal fittings 10 at a front limit position. The front wall 44 of the female housing 40 is formed with tab insertion holes 45 for permitting the tabs of the mating male terminal fittings to be inserted into the cavities 41 from the front. Converging guide surfaces 46 are formed at the front edges of the tab insertion holes 45 over substantially the entire periphery, so that the tabs can be inserted smoothly.

A projection-inserting groove 47 and a stabilizer-inserting groove 48 are formed in the bottom wall 42 of the cavity 41 and have open rear ends. The projection-inserting groove 47 is substantially in the widthwise center of the cavity 41, whereas the stabilizer-inserting groove 48 is at the right side of the projection-inserting groove 47 in FIG. 2. The projection-inserting groove 47 is substantially continuous with the lock 43, as described below, whereas the front end of the stabilizer-inserting groove 48 is slightly behind the lock 43.

A jutting portion 49 is provided at the front end of the upper surface of the cavity 41 and gradually projects out toward the lock 43 over the substantially entire width. The front end of the female terminal fitting 10 inserted into the cavity 41 is pushed toward the lock 43 by the jutting portion 49 to increase a depth of engagement with the lock 43. The peripheral edge of the rear end of the cavity 41 is inclined in to the front over substantially the entire periphery to guide the female terminal fitting 10 (see FIG. 2). However, a restricting portion 50 is provided at the upper-left of the peripheral edge of the rear end of the cavity 41 in FIG. 2 and extends substantially normal to the inserting and withdrawing directions IWD of the female terminal fitting 10. The restricting portion 50 contacts the stabilizer 25 when the female terminal fitting 10 is inserted into the cavity 41, thereby hindering the insertion of the stabilizer 25. Further, the front part of the cavity 41 is narrower than substantially the rear part thereof, as shown in FIG. 9.

A retainer mount hole 51 is formed in the bottom wall of the female housing 40, as shown in FIG. 7, and exposes portions of the cavities 41 slightly behind the locks 43*a*. A retainer 52 can be mounted into the retainer mount hole 51 from below and is vertically movable between a partial locking position (see FIG. 7) and a full locking position (see FIG. 14). The retainer 52 includes fasteners 53 arrayed at two stages corresponding to the respective cavities 41. The fasteners 53 are retracted down from the corresponding cavities 41 when the retainer 52 is in the partial locking position to permit the insertion and withdrawal of the female terminal fittings 10 into and from the cavities 41. However, the fasteners 53 enter the corresponding cavities 41 when the retainer 52 is in the full locking position to lock the female terminal fittings 10. The retainer 52 can be held selectively at the partial locking position and the full locking position by an unillustrated holding means.

Figure 3:
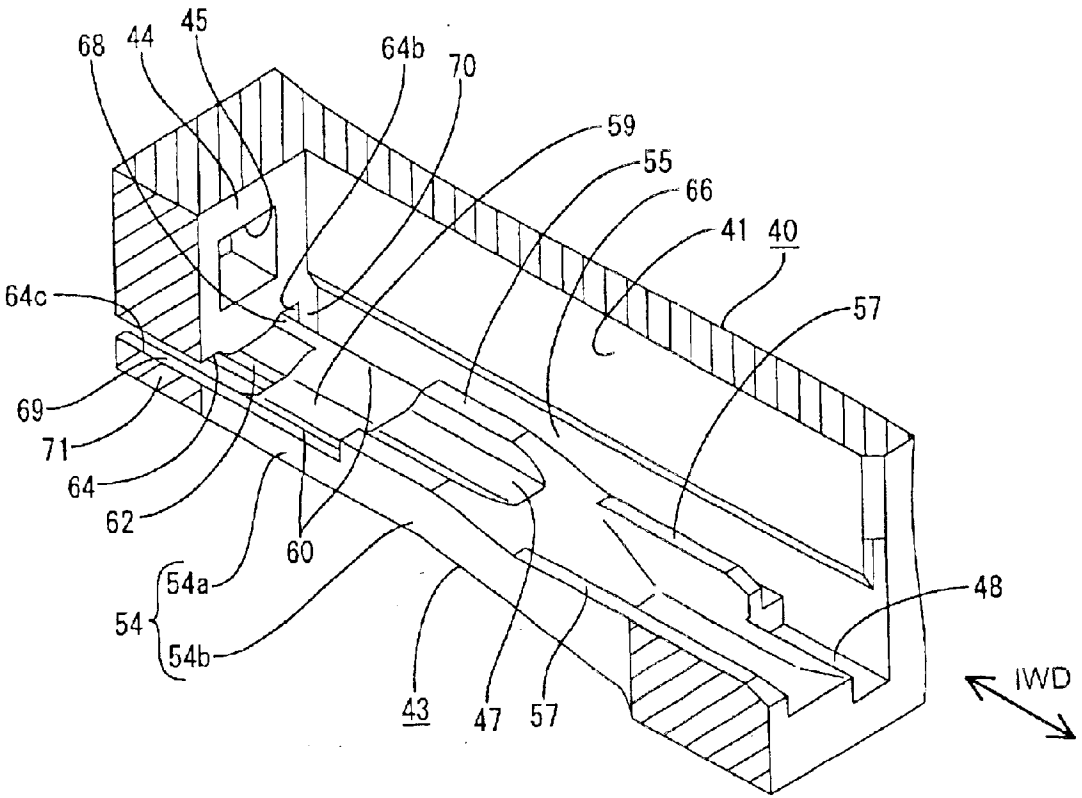
FIG. 3 is a perspective view partly in section of the female housing.

The lock 43 is at the front part of the bottom wall 42 of the cavity 41 before the retainer mount hole 51, as shown in FIGS. 3 and 7, and has an arm 54 supported at both front and rear ends. A fastening projection 55 projects into the cavity 41 from the upper surface of the arm 54 and can enter the cut-away portion 21 of the female terminal fitting 10 to engage the front cut end surface 21*a*. The lock 43 is substantially transversely symmetrical when viewed from front.

Figure 9:
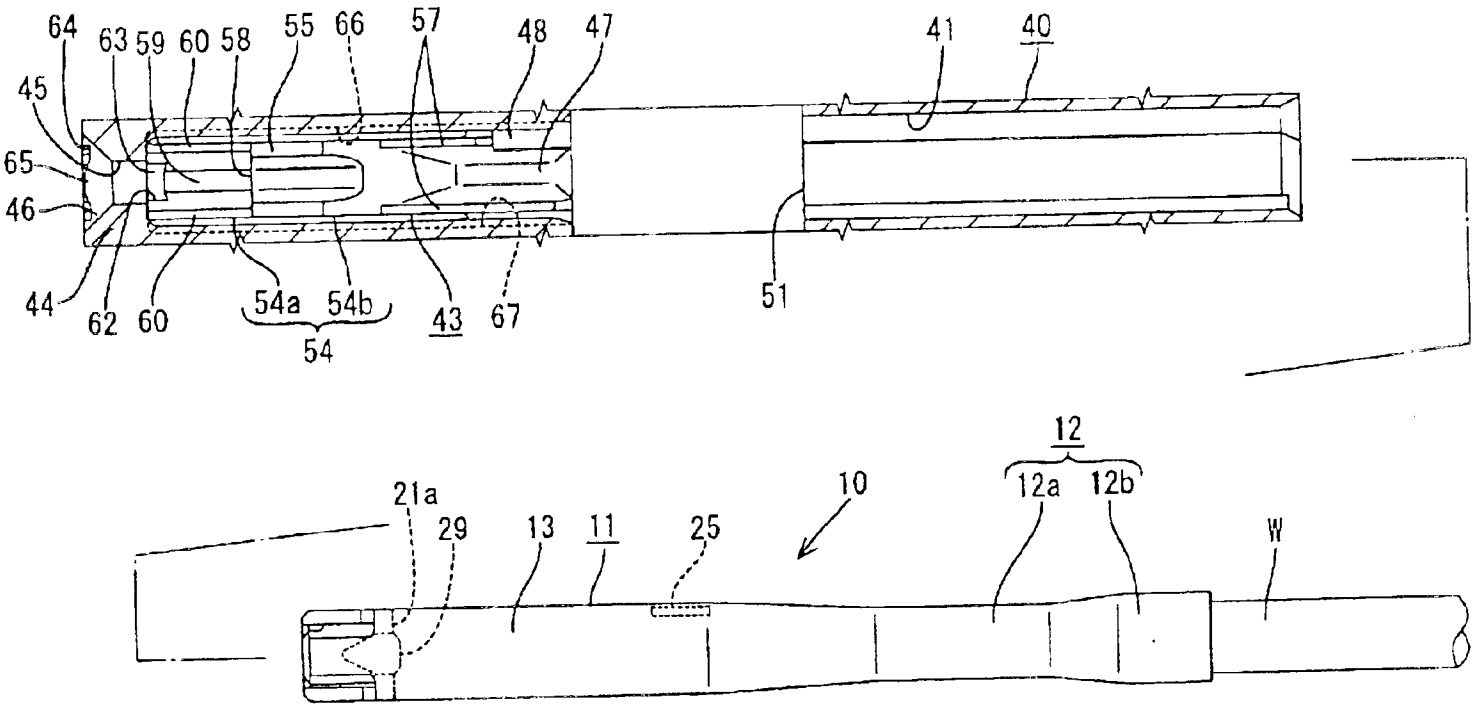
FIG. 9 is a plan view in section (the female housing is shown by a section along 9—9 of FIG. 1 and the female terminal fitting is shown by a plan view) showing the state before the female terminal fitting is inserted into the female housing with the retainer mounted at the partial locking position.
Figure 10:
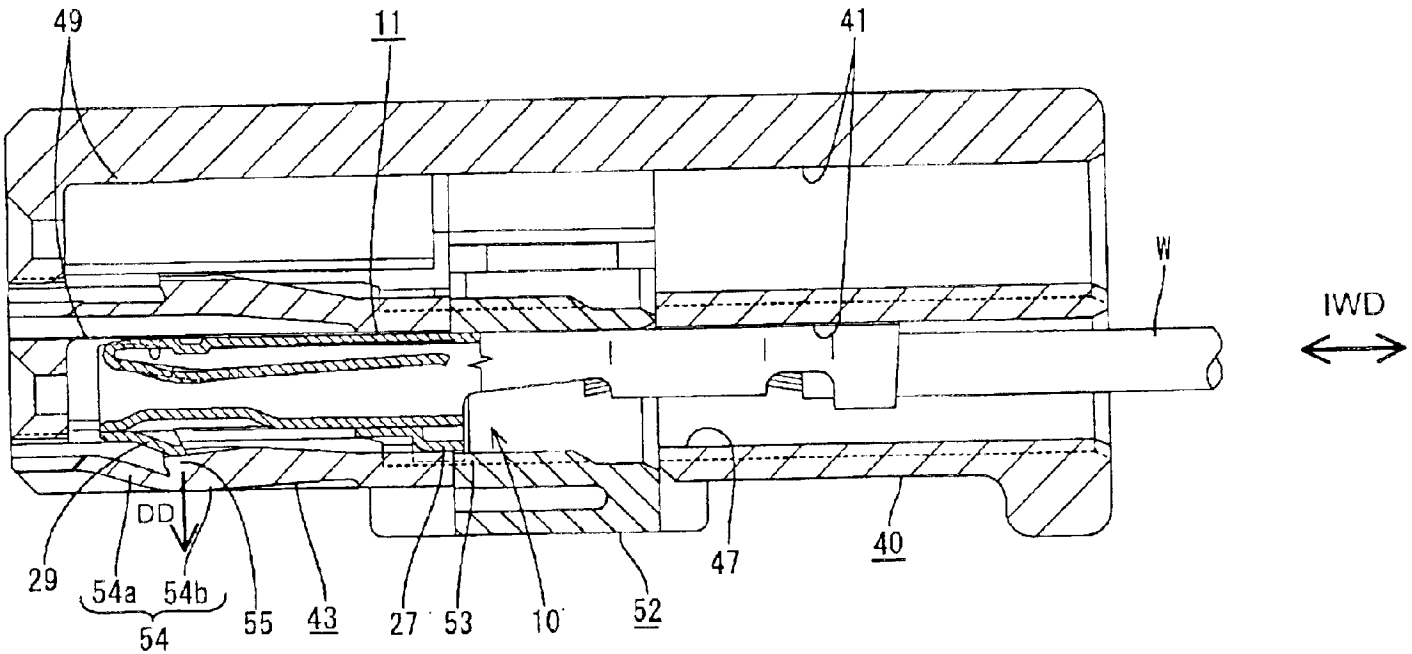
FIG. 10 is a sectional view similar to FIG. 7, but showing an intermediate stage of inserting the female terminal fitting into the housing.

The arm 54 is slightly narrower than the cavity 41, as shown in FIG. 9, and has chamfered bottom edges, as shown in FIG. 1. The arm 54 defines a substantially bridge-shape with supports at opposed front and rear ends. Longitudinal middle portions of the arm 54 are resiliently deformable vertically in a deformation direction DD, as shown in FIG. 10. A deformation permitting space is defined below the arm 54 to permit resilient deformation of the arm 54 in the deformation direction DD. Two excessive deformation-preventing rails 56 are spaced below the opposite chamfered sides of the arm 54 by the height of the deformation permitting space. The excessive deformation-preventing rails 56 have a substantially triangular cross section and extend along the longitudinal direction of the lock 43. The excessive deformation preventing rails 56 engage the lock 43 before the lock 43 is deformed beyond its resiliency limit. A rear portion 54*b* of the arm 54 is connected with the bottom wall 42 over substantially the entire width. The arm 54 then slopes up toward the front, whereas a front portion 54*a* of the arm 54 is connected partly with the front wall 44 of the female housing 40 and is substantially horizontal. The projection-inserting groove 47 in the bottom wall 42 is continuous with the rear portion 54*b,* and parts of the rear portion 54*b* left at the opposite sides of the projection-inserting groove 47 define rear supports 57 for supporting the female terminal fitting 10 laterally and from below.

The fastening projection 55 is as wide as the arm 54 (see FIG. 9), and the front end of the fastening projection 55 aligns with the front end of the rear portion 54*b* of the arm 54. The rear surface of the fastening projection 55 is inclined to be continuous with the rear portion 54*b* of the arm 54. A locking surface 58 is at the front of the fastening projection 55 and is engageable with the female terminal fitting 10. The locking surface 58 extends substantially normal to the inserting and withdrawing directions IWD of the female terminal fitting 10. The projection-inserting groove 47 in the rear portion 54*b* of the arm 54 is formed continuously in the fastening projection 55. Thus, the fastening projection 55 is recessed in its widthwise middle when viewed from front (see FIG. 1).

A maneuverable groove 59 is formed in the widthwise center of the upper surface of the front portion 54*a* of the arm 54 over the substantially entire length of the arm 54 and is open forward. A disengagement jig J (see FIG. 15) can be inserted into the maneuverable groove 59 from the front to deform the lock 43. Front supports 60 are formed at the front portion 54*b* of the arm 54 on opposite sides of the maneuverable groove 59 for supporting the female terminal fitting 10 laterally or from below. The front portion 54*a* of the arm 54 is thinner than the rear portion 54*b* due to the maneuverable groove 59. The maneuverable groove 59 has a depth slightly over half the thickness of the front portion 54*a* of the arm 54, and opposite side surfaces of the maneuverable groove 59 incline up to the opposite outer sides to conform substantially to the outer shape of the arm 54 (see FIG. 1). The locking projection 29 of the female terminal fitting 10 can enter the maneuverable groove 59. An extended locking surface 61 is formed at the rear end of the maneuverable groove 59 (see FIG. 7). The extend locking surface 61 is substantially continuous with the locking surface 58 of the fastening projection 55 and is engageable along the front cut end surface 21*a* of the cut-away portion 21 of the female terminal fitting 10.

A jig-introducing groove 62 is formed at the front half of the front portion 54*a* of the arm 54 and communicates with the maneuverable groove 59 to permit the introduction of the disengagement jig J. This jig-introducing groove 62 splits the front half of the front portion 54*a* of the arm 54. A guide surface 63 is formed at the rear end of the jig-introducing groove 62 and inclines up to the back for guiding the disengagement jig J into the maneuverable groove 59.

Openings 64 are below the tab insertion holes 45 in the front wall 44 of the female housing 40 and open forward as shown in FIG. 1. The openings 64 are created by removing a mold for forming the front surface contour and the side surface contours of the lock 43. Each opening 64 has a height that substantially equals the entire height of the lock 43 and slightly cuts the bottom end of the guide surface 46. However, a projection 65 projects down from an upper surface 64*a* of the opening 64 along the outer shape of the fastening projection 55, and the guide surface 46 extends continuously to the projection 65. Mold-removal grooves 66, 67 are formed in a portion of the female housing 40 behind the front wall 44, as shown in FIG. 2. The mold-removal grooves 66 and 67 are created by removing a mold for forming the rear surfaces of connected portions 70, 71 and the opposite side surfaces of the upper part of the arm 54 and the fastener 55. The mold-removal grooves 66, 67 communicate with the cavity 41 at the opposite sides of the lock 43 and open backward. Opposite bottom ends of the rear half of the cavity 41 are cut out by the mold-removal grooves 66, 67.

The jig-introducing groove 62 divides the front portion 54*a* of the arm 54 into left and right branches 68 and 69 that are connected with side surfaces 64*b*, 64*c* of the opening 64 as shown in FIG. 1. The connected portions 70, 71 are spaced sideways from the branches 68, 69 of the arm 54 in a direction intersecting the deforming direction DD of the lock 43. Specifically, the connected portions 70, 71 are at positions that will not hinder the formation of the fastening projection 55 and the locking surface 58 in an area extending over substantially the entire width of the arm 54. Therefore, the widths of the fastening projection 55 and the locking surface 58 substantially equal the entire width of the lock 43. Further, the branches 68, 69 and the locking surface 58 are substantially adjacent vertically.

The connector is assembled, as shown in FIGS. 7 to 9, by mounting the retainer 52 in the female housing 40 at the partial locking position. The female terminal fitting 10 then is inserted into the cavity 41 from behind with the barrel 12 of the female terminal fitting 10 crimped, bent or folded into connection with the wire W. An attempt may be made to insert the female terminal fitting 10 upside down so that the stabilizer 25 faces up. However, the front end surface of the upwardly-facing stabilizer 25 will contact the restricting portion 50 at the peripheral edge of the rear end of the cavity 41, thereby hindering the insertion of the female terminal fitting 10. In this way, an upside-down insertion of the female terminal fitting 10 is prevented.

The locking projection 29 of the properly oriented female terminal fitting 10 enters the projection-inserting groove 47 of the cavity 41. The projection 27 and the stabilizer 25 then enter the projection-inserting groove 47 and the stabilizer-inserting groove 48, respectively. As a result, the female terminal fitting 10 is inserted smoothly into the cavity and is prevented from shaking vertically and transversely. Sufficient insertion of the female terminal fitting 10 urges the locking projection 29 into the lock 43. As a result, the arm 54 deforms down in the deformation direction DD, as shown in FIG. 10. The deformed arm 54 defines a shallow V-shape when viewed sideways so that the front portion 54*a* is inclined backward while the rear portion 54*b* is inclined forward. The locking projection 29 has a substantially pyramidal shape with a vertex at the front end. Thus, the locking projection 29 is inserted smoothly along the projection-inserting groove 47 and smoothly presses the lock 43.

An operator may mistakenly believe that an insufficiently inserted female terminal fitting 10 has reached a proper depth and may try to move the retainer 52 to the full locking position. In such a case, the fastener 53 of the retainer 52 contacts the bottom surface of the main body 11 of the female terminal fitting 10, thereby preventing movement of the retainer 52 to the full locking position. Thus, the insufficient insertion of the female terminal fitting 10 is detected.

Figure 11:
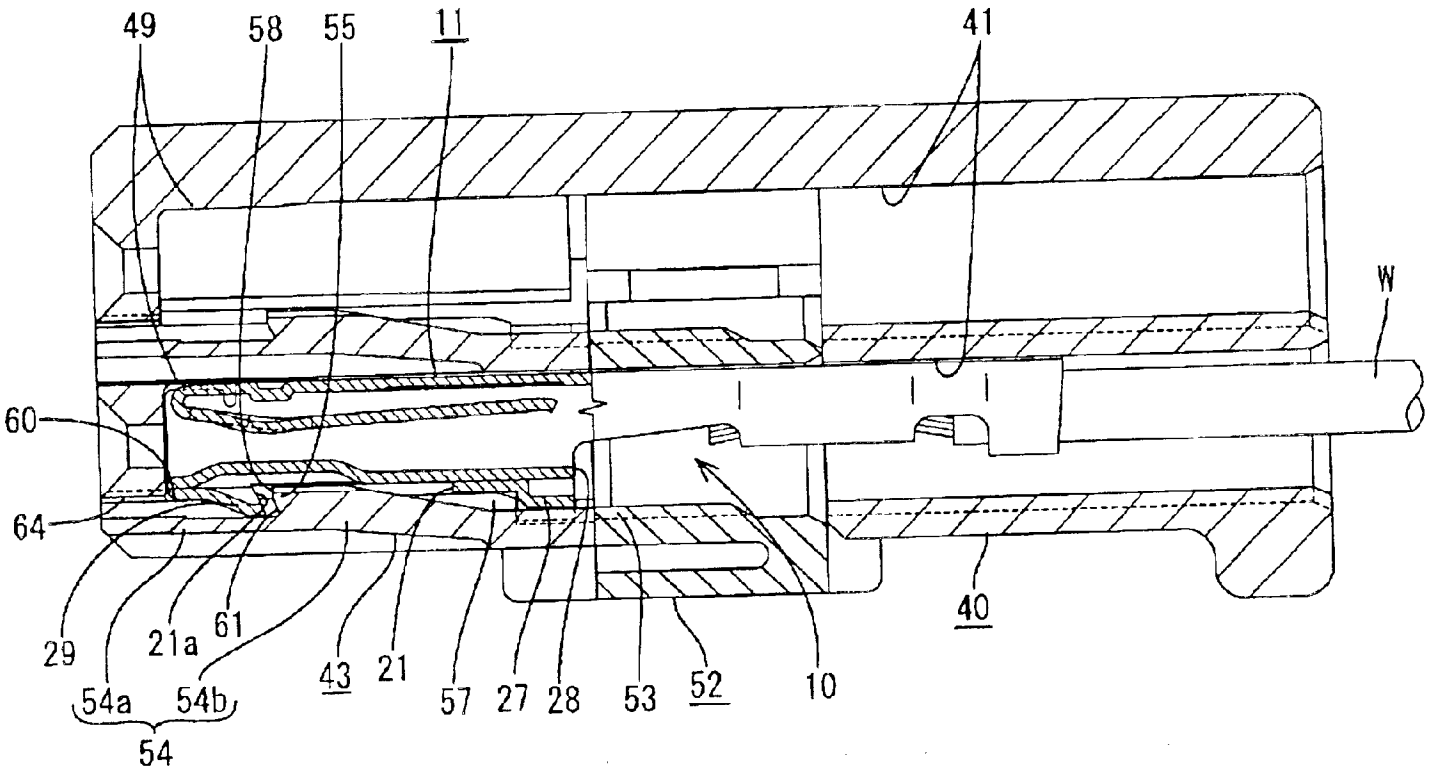
FIG. 11 is a side view in section similar to FIG. 7, but showing a state where the female terminal fitting is inserted in the female housing.
Figure 12:
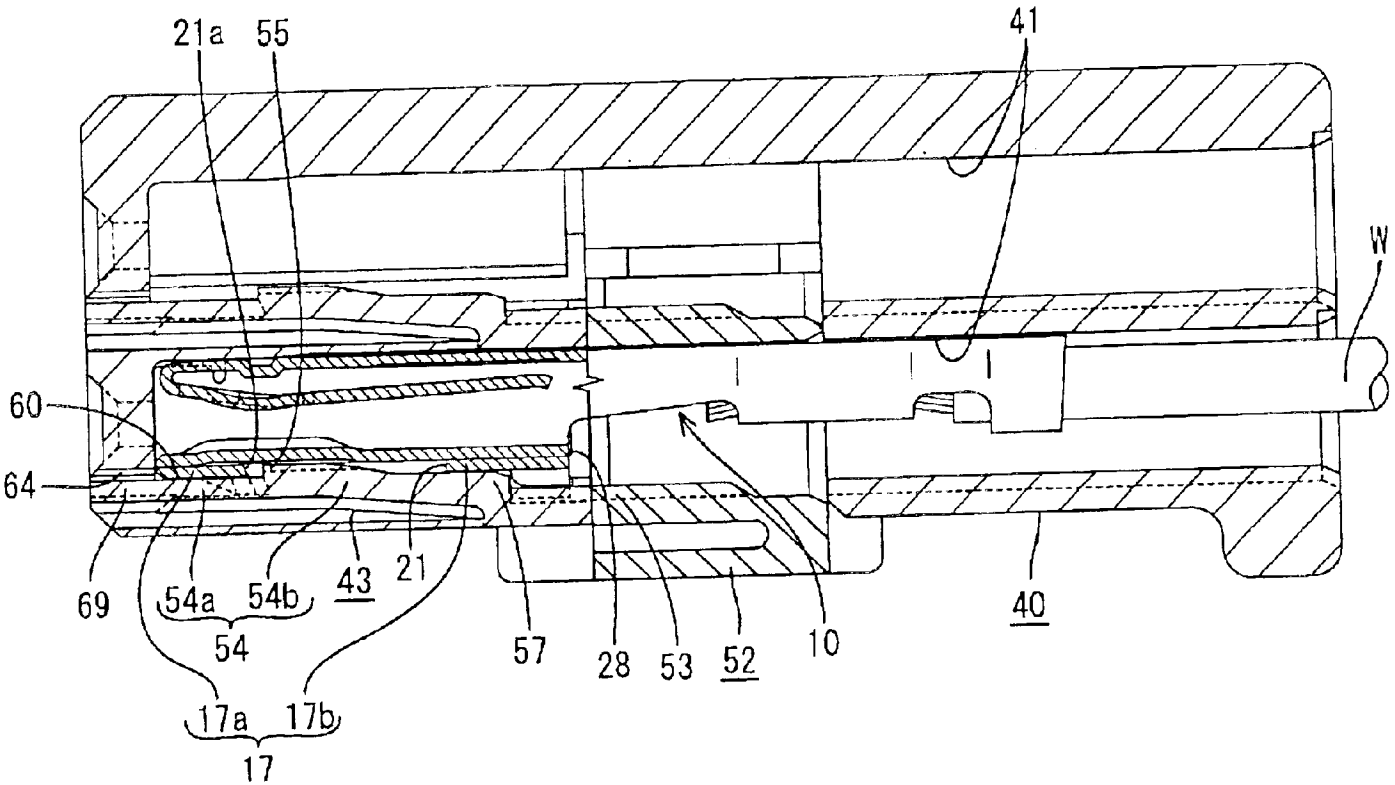
FIG. 12 is a side view in section similar to FIG. 8, but showing the state where the female terminal fitting is inserted in the female housing.
Figure 13:
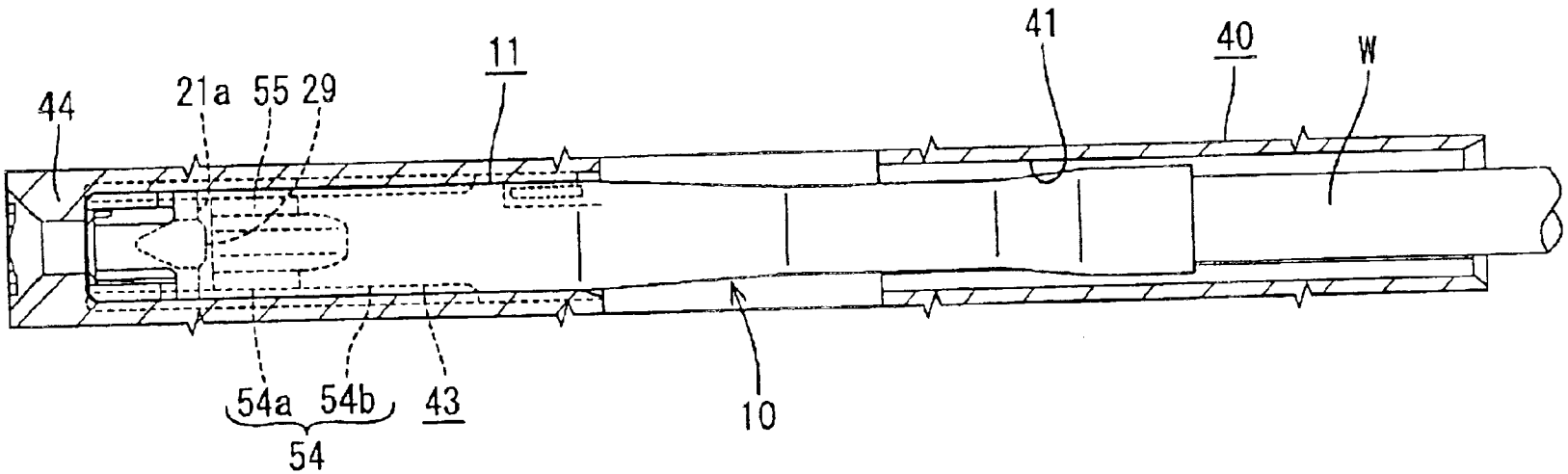
FIG. 13 is a plan view in section similar to FIG. 9, but showing the state where the female terminal fitting is inserted in the female housing.

The locking projection 29 of the properly inserted female terminal fitting 10 moves forwardly beyond the fastening projection 55 and enters the maneuverable groove 59 of the lock 43, as shown in FIGS. 11 to 13. As a result, the lock 43 is restored resiliently and the fastening projection 55 of the lock 43 enters the cut-away portion 21. The locking surface 58 and the extended locking surface 61 of the lock 43 engage the front cut end surface 21*a* of the cut-away portion 21, including the rear end surface of the locking projection 29. In this way, the female terminal fitting 10 is held by the lock 43 so as not to come out. The jutting portion 49 on the ceiling surface of the cavity 41 pushes the front end of the main body 11 of the female terminal fitting 10 down toward the locking projection 43 as the female terminal fitting 10 is inserted. Thus, the female terminal fitting 10 is displaced toward the lock 43 and the depth of engagement of the lock 43 with the female terminal fitting 10 is increased. The locking surface 58 of the lock 43 is formed across the entire width of the lock 43 and hence across most of the width of the cavity 41. Additionally, the front cut end surface 21*a* of the cut-away portion 21 of the female terminal fitting 10 extends across substantially the entire width of the female terminal fitting 10, including the front portion 17*a* of the outer wall 17, the locking projection 29 and the front-portion holding piece 30. Thus, the female terminal fitting 10 is held by a strong locking force and will not come out of the cavity 41. Further, the front cut end surface 21*a* of the cut-away portion 21 is inclined up to the back toward the lock 43 and the extended locking surface 61 is inclined to conform substantially to the front cut end surface 21*a*. Thus, the locking force is stronger.

Figure 14:
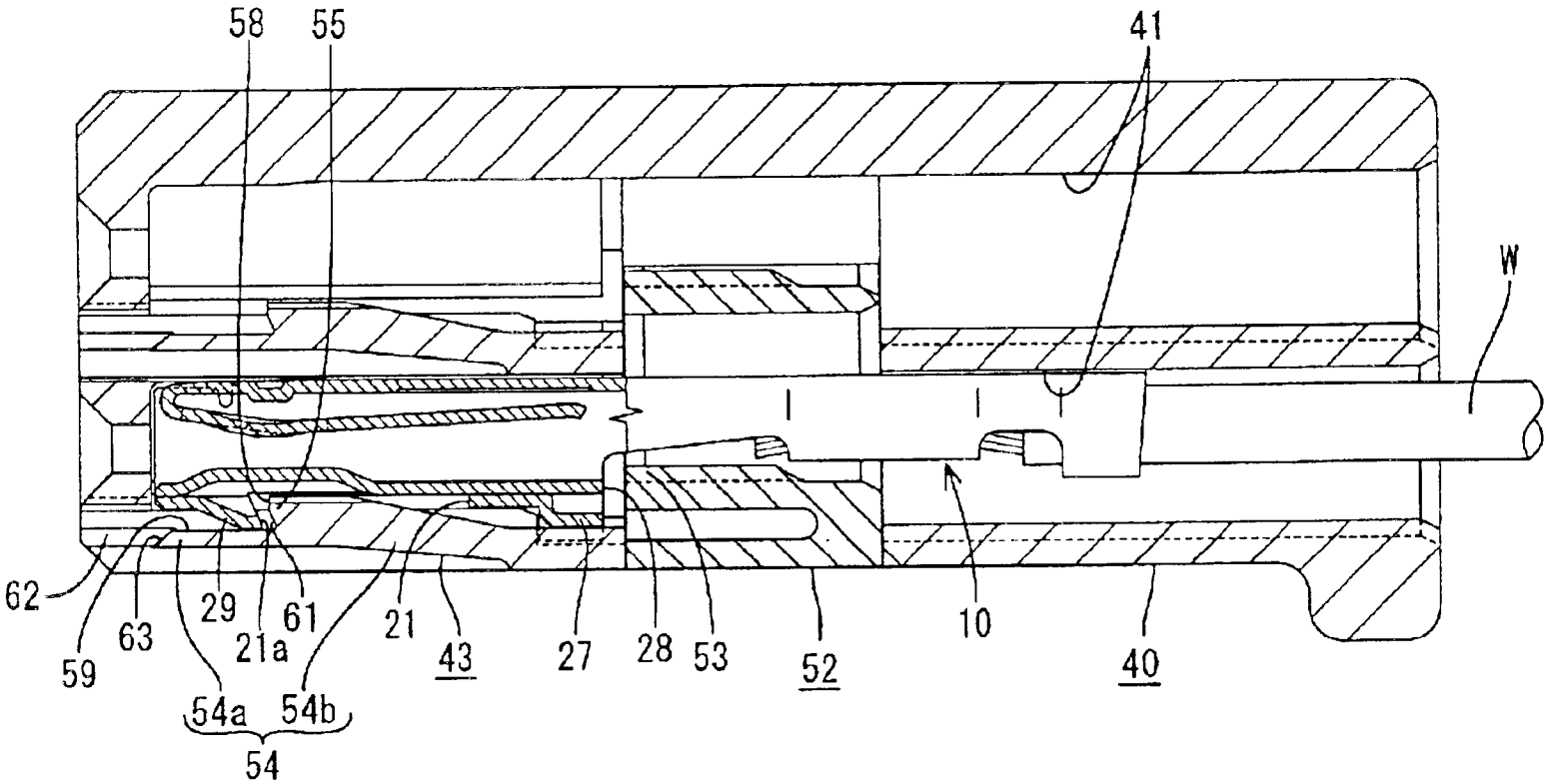
FIG. 14 is a side view in section similar to FIG. 7, but showing a state where the retainer is moved to a full locking position.
Figure 15:
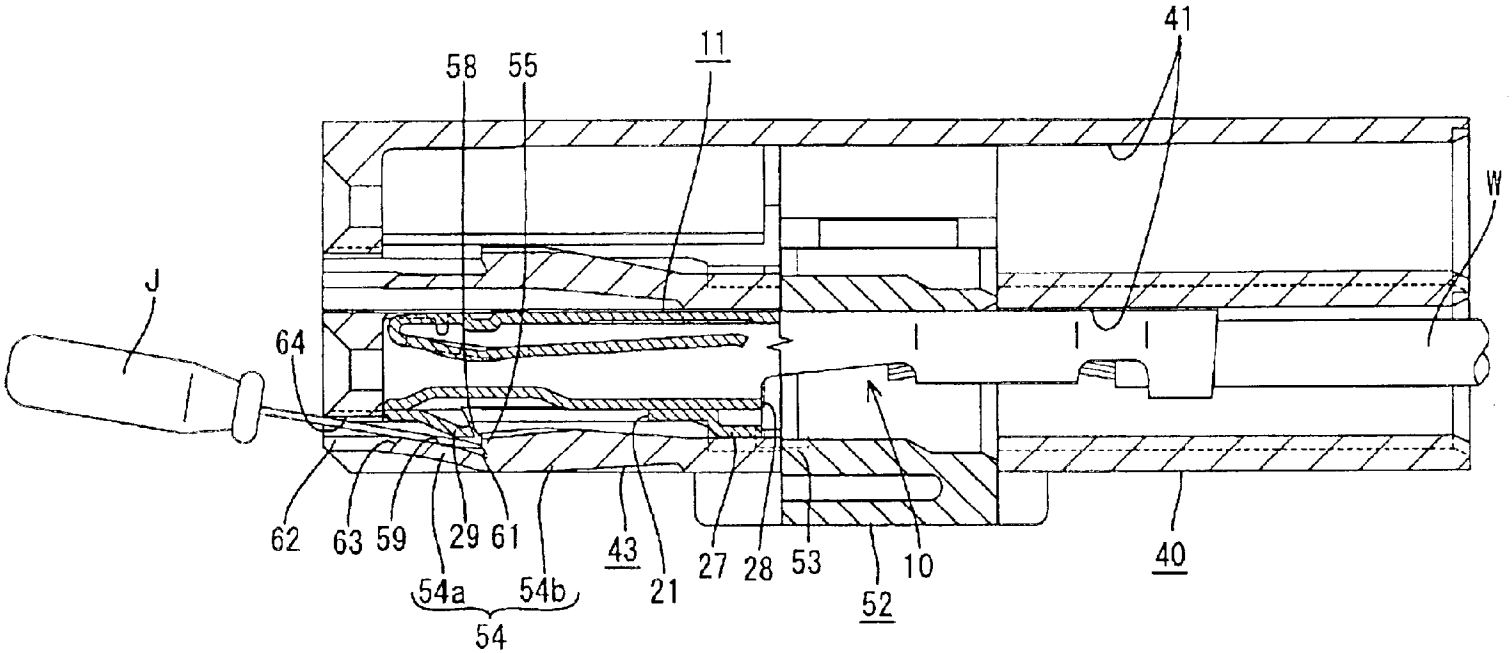
FIG. 15 is a side view in section similar to FIG. 7, but showing a state where a lock is deformed by a disengagement jig.

The retainer 52 is moved to the full locking position, as shown in FIG. 14, after all the female terminal fittings 10 have been inserted properly into the corresponding cavities 41. Thus, the fasteners 53 enter the corresponding cavities 41 to engage the steps 28 including the projections 27. In this way, the female terminal fittings 10 are locked doubly locked in the cavities 41 by the locks 43 and the retainer 52.

The terminal fitting 10 may have to be withdrawn from the female housing 40 for maintenance or some other reason. In such a case, the retainer 52 is returned from the full locking position to the partial locking position, as shown in FIG. 11. The disengagement jig J then is inserted into the jig-introducing groove 62 and the maneuverable groove 59. The jig-introducing groove 62 has a wide entrance, and hence the initial insertion of the disengagement jig J can be performed easily. Further, the guide surface 63 at the rear end surface of the jig-introducing groove 62 is inclined toward the maneuverable groove 59, and the disengagement jig J can be guided smoothly to the maneuverable groove 59. The disengagement jig J can be inserted to the back of the maneuverable groove 59 and moved along the inclination of the outer surface of the locking projection 29. Thus, the wall surface of the maneuverable groove 59 is pushed down by the leading end of the disengagement jig J to deform the arm 54 and to disengage the lock 43 from the female terminal fitting 10. The wire W can be gripped and pulled to remove the female terminal fitting 10 from can be pulled out of the cavity 41.

As described above, the lock 43 is supported at both ends. Thus, as compared to the conventional lock supported only at one end, the lock 43 has a higher strength even if thinned. Accordingly, a locking force on the female terminal fitting 10 is enhanced, and the connector is suited for miniaturization.

The branches 68, 69 of the front portion 54*a* of the arm 54 are forward of the locking surface 58 of the lock 43 and connect with the side surfaces 64*b*, 64*c* of the opening 64, which extend substantially along the deforming direction DD of the lock 43. Thus, the connected portions 70, 71 are not a hindrance in forming the locking surface 58. Accordingly, the locking surface 58 can be wide and adjacent the branches 68, 69 substantially along the deforming direction DD of the lock 43. Therefore, sufficient locking forces can be secured for the female terminal fittings 10 even if the female connector is miniaturized.

The lock 43 is connected with the side surfaces 64*b*, 64*c* of the opening 64 that facing each other. Thus, the locking surface 58 has a width substantially equal to the entire width of the lock 43 and can engage the female terminal fitting 10 over substantially the entire width. Accordingly, the force to lock the female terminal fitting 10 can be enhanced.

The locking projection 29 that projects from the female terminal fitting 10 can enter the maneuverable groove 59 in the lock 43, and the extended locking surface 61 is engageable with this locking projection 29. Thus, the force to lock the female terminal fitting 10 can be enhanced even more.

A second embodiment of the invention is described with reference to FIGS. 16 to 25. The lock 43A and the female terminal fitting 10A of the second embodiment are configured differently than in the first embodiment. However, many other parts of the second embodiment are substantially the same as in the first embodiment. Parts of the second embodiment that are substantially the same as the first embodiment are not described, but rather are identified by the same reference numeral.

Figure 20:
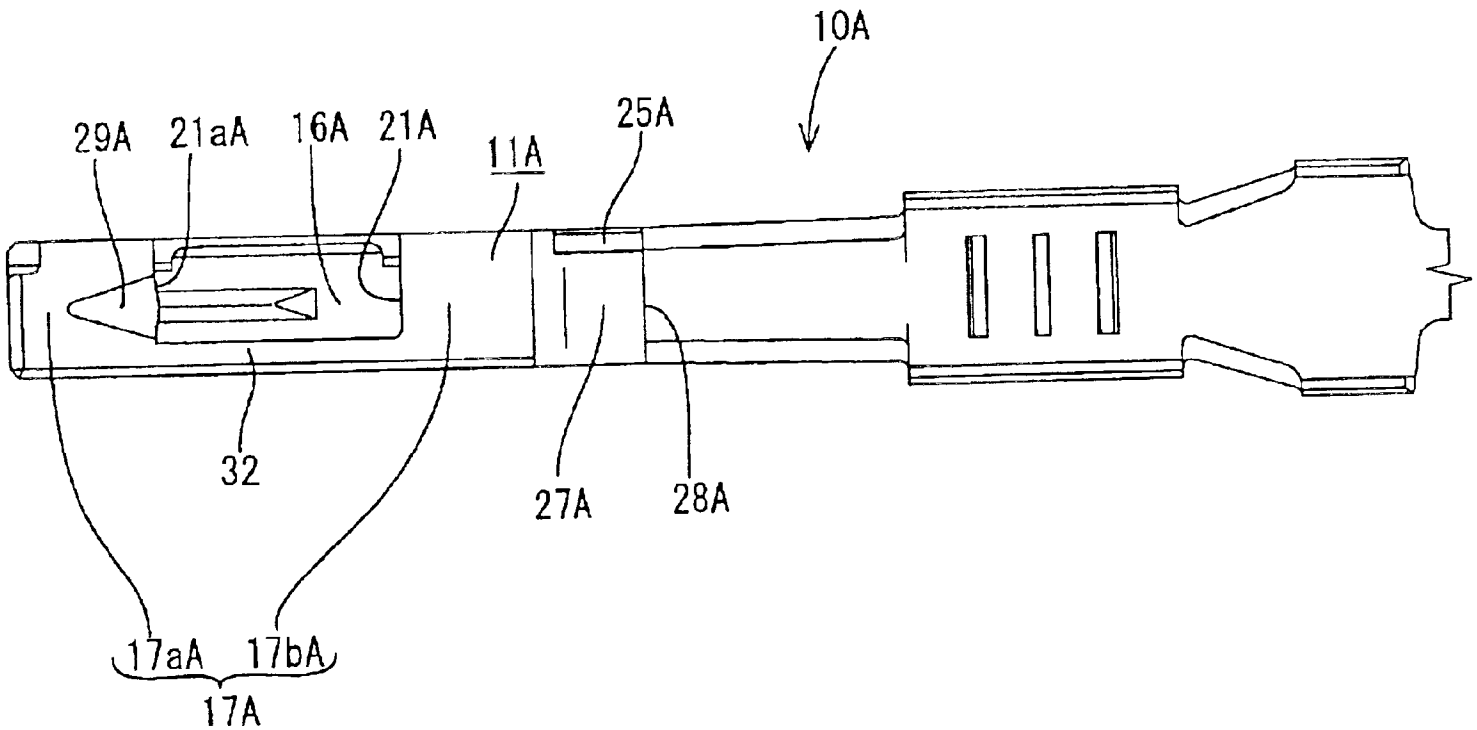
FIG. 20 is a bottom view of the female terminal fitting.

The female terminal fitting 10A has a main body 11A with a cut-away portion 21A formed to leave a projecting end of an outer wall 17A over the entire length, as shown in FIG. 20. Thus, the projecting ends of a front portion 17*a*A and a rear portion 17*b*A of the outer wall 17A are connected by a reinforcing piece 32 that extends in forward and backward directions. The cut-away portion 21A is narrower the cut-away portion 21 of the first embodiment. However, the strengths of the front and rear portions 17*a*A, 17*a*B of the outer wall 17A are stronger than in the first embodiment where the outer wall 17A is divided into the front and rear portions by the cut-away portion 21. The front portion 17*a*A of the outer wall 17A is supported by the reinforcing piece 32 and hence is less likely to undergo an opening deformation in response to a pulling force on the female terminal fitting 10A while the lock 43A is engaged with the front portion 17*a*A of the outer wall 17A.

Figure 19:
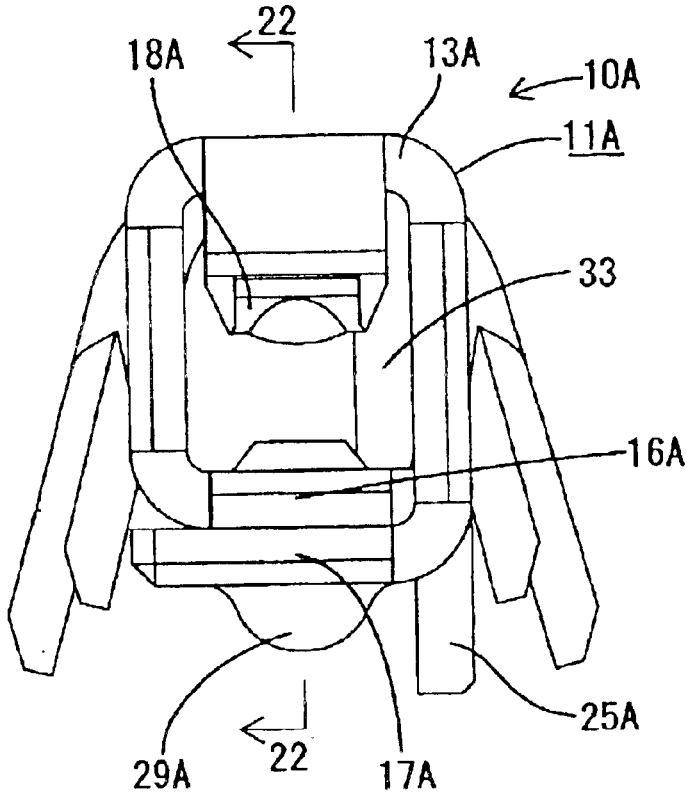
FIG. 19 is a front view of a female terminal fitting.
Figure 21:
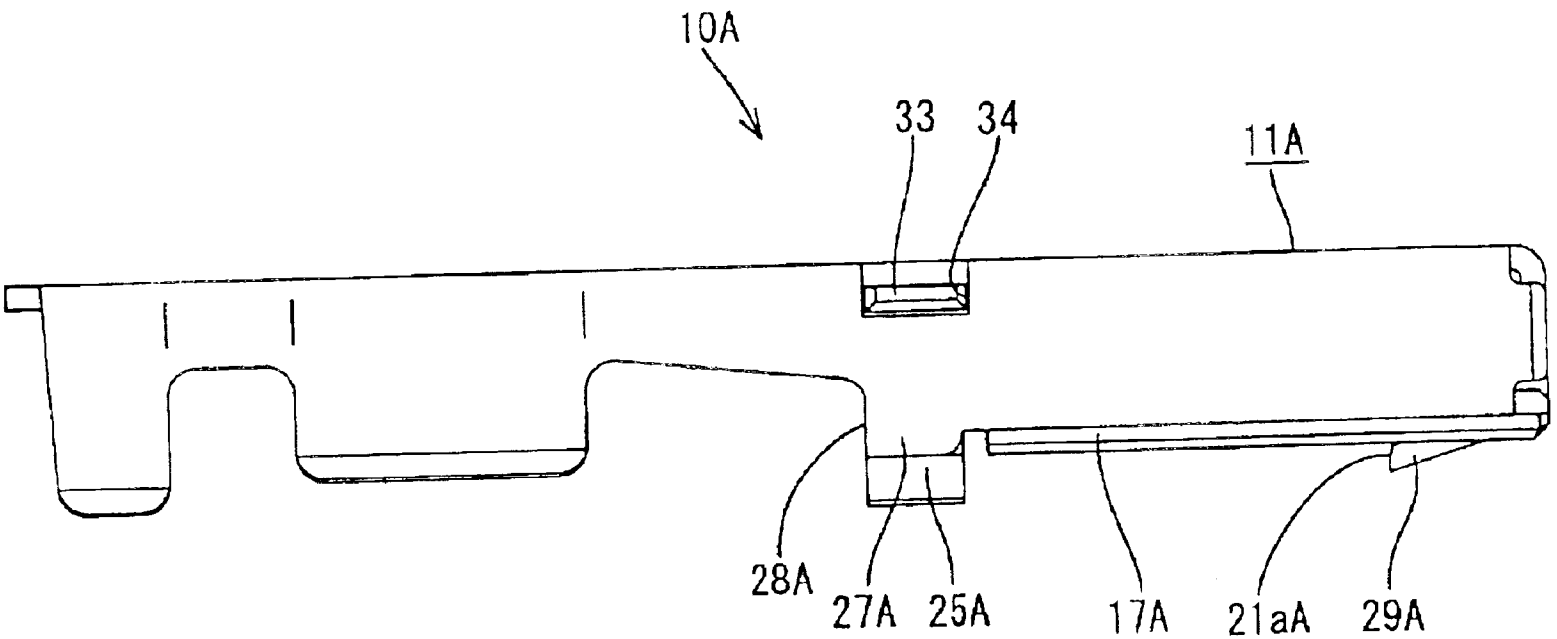
FIG. 21 is a left side view of the female terminal fitting.
Figure 22:
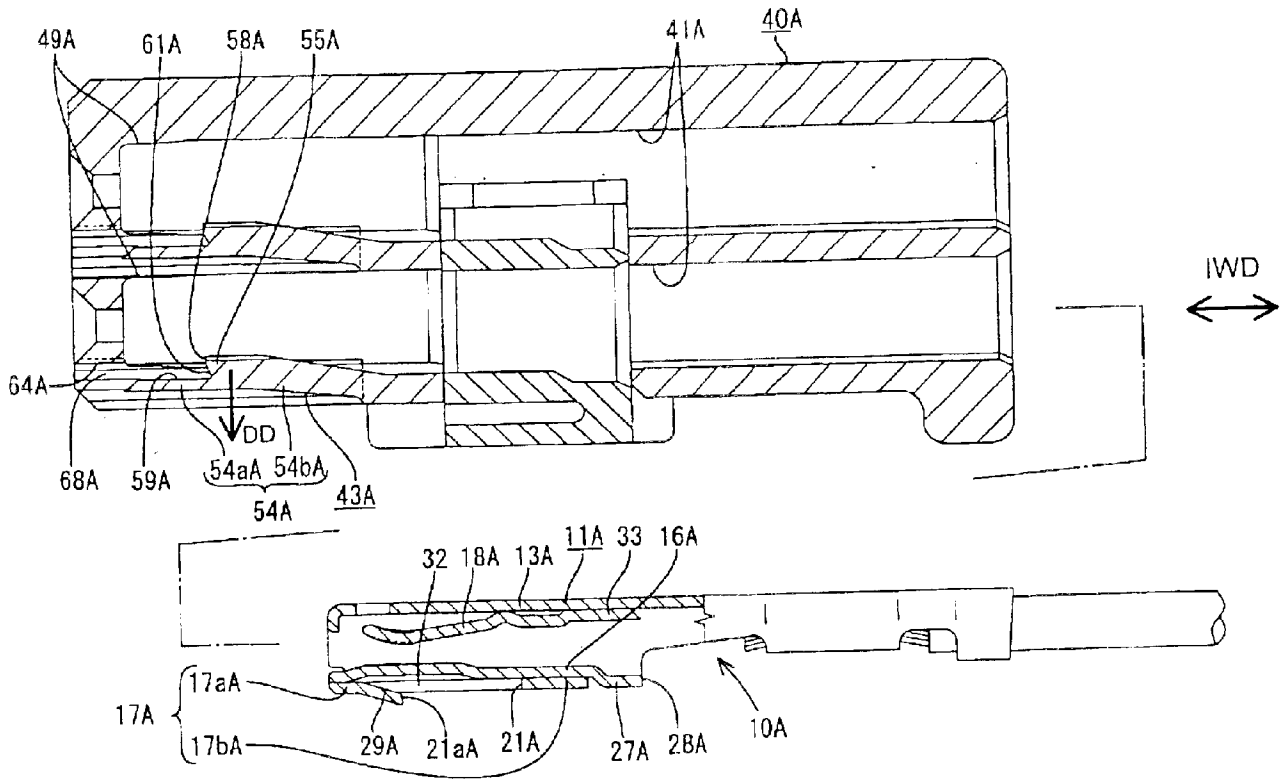
FIG. 22 is a side view in section (the female housing is shown by a section along 22—22 of FIG. 16 and the female terminal fitting is shown by a section along 22—22 of FIG. 19) showing a state before the female terminal fitting is inserted into the female housing.

A rear end part of the front portion 17*a*A of the outer wall 17A is embossed to project down and forms a locking projection 29A as shown in FIGS. 20 and 21. The locking projection 29A has a substantially triangular pyramidal shape with a vertex at the front end. The rear end of the locking projection 29A is undercut to overhang backward. The rear portion 17*b*A of the outer wall 17A has its rear end cut out by a specified length, and a portion of a bottom wall 16A corresponding to the cut-out portion is embossed to project down and to form a projection 27A. The projection 27A includes a step 28A for engaging a retainer 52A. A stabilizer 25A projects down from the rear end of the projecting end of a sidewall 15A at the right side of the projection 27A in FIG. 19. The stabilizer 25A is reversed transversely from the stabilizer 25 of the first embodiment (see FIG. 4). The resilient contact piece 18A is supported at only one end and, as shown in FIGS. 19 and 22, is formed by folding a piece 33 that projects from a lateral edge of the rear end of a ceiling wall 13A to extend forward along the ceiling wall 13A from the front end of the piece 33. The leading end of the piece 33 is inserted into a hole 34 in a sidewall 14A to prevent forward and backward displacements of the resilient contact piece 18A. The female terminal fitting 10A has no equivalent of the front-portion holding piece 30, the front-portion holding groove 31, the rear-portion holding piece 24, the rear-portion holding groove 26, the recess 23 and/or the excessive deformation preventing projection 20 shown in the first embodiment.

Figure 16:
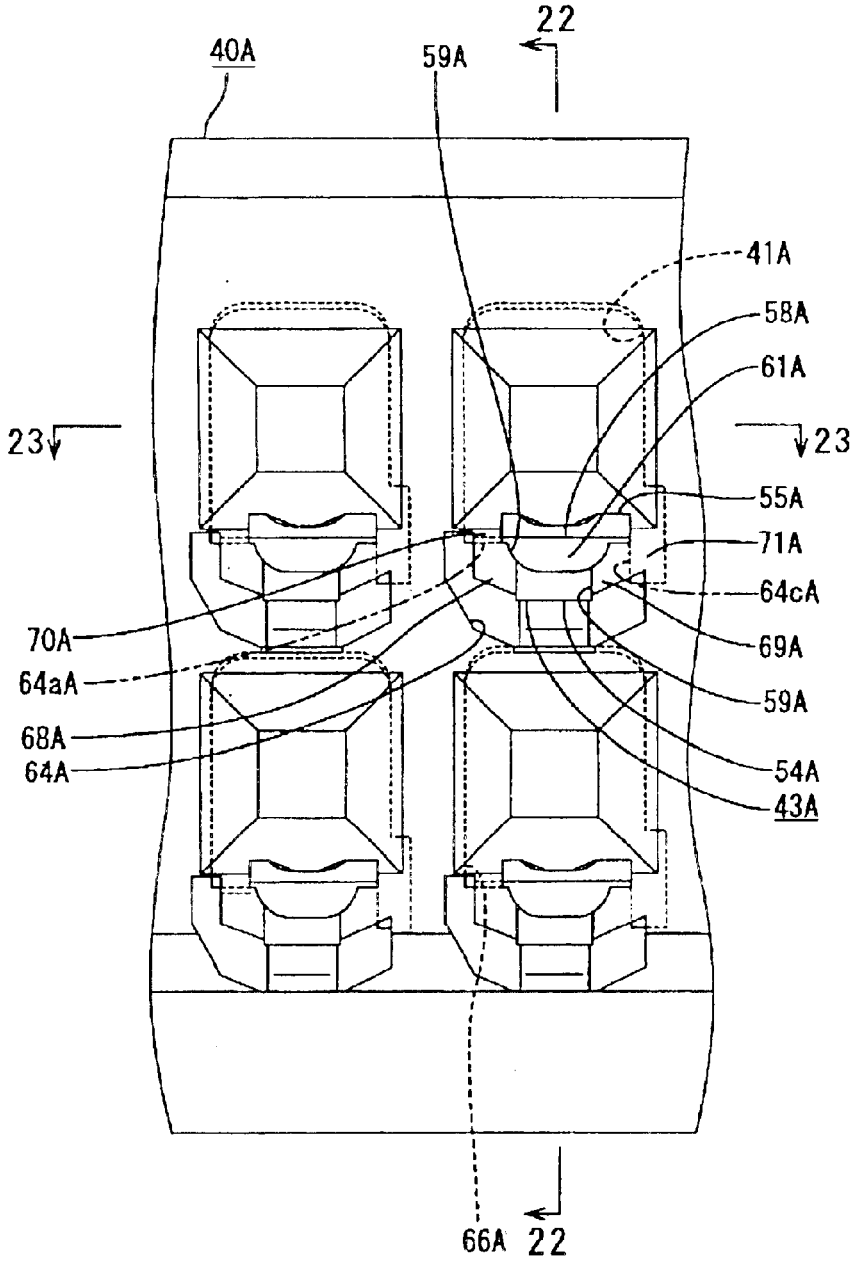
FIG. 16 is a front view of a female housing according to a second embodiment of the invention.
Figure 17:
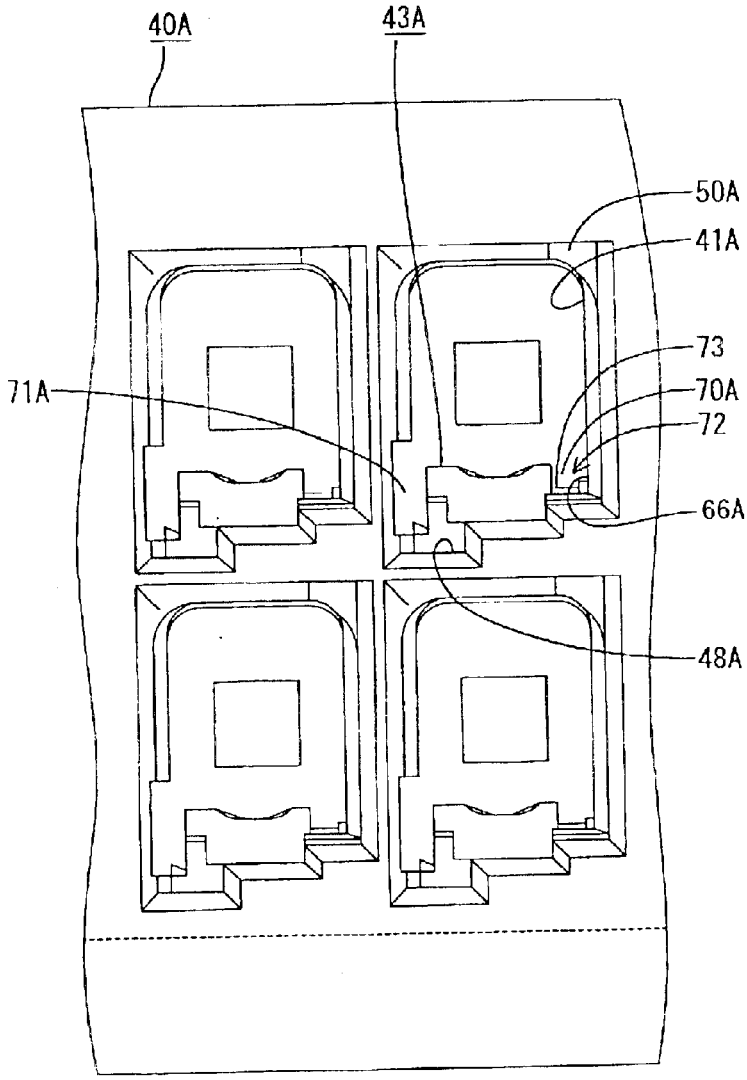
FIG. 17 is a rear view of the female housing.

The female housing 40A is shown in FIG. 16 and has a lock 43A that is formed asymmetrical in the widthwise direction. The lock 43A has an arm 54A with a front portion 54*a*A formed with a pair of branches 68A, 69A. The right branch 69A in FIG. 16 is connected with a right side surface 64*c*A of an opening 64A, whereas the left branch 68A is connected with an upper surface 64*a*A of the opening 64A. A connected portion 71A with the right branch 69A is displaced sideways from the arm 54A, whereas a connected portion 70A with the left branch 68A is displaced up from the arm 54A. A mold needs to be removed back from the left connected portion 70A to form the connected portion 70A. However, the fastening projection 55A and a locking surface 58A cannot be formed in a range that overlaps the connected portion 70A when viewed from the front. In other words, the formation range of the left connected portion 70A is restricted by the fastening projection 55A and the locking surface 58A. Accordingly, the left ends of the fastening projection 55A and the locking surface 58A overlap the left connected portion 70A and are cut out. The widths thereof are smaller than the width of the locking portion 43A by the width of the left connected portion 70A. Conversely, escaping spaces 72 are defined at the right lateral side of the fastening projections 55A by mold-removal holes 66A formed by removing the mold for forming the connected portions 70A.

Figure 18:
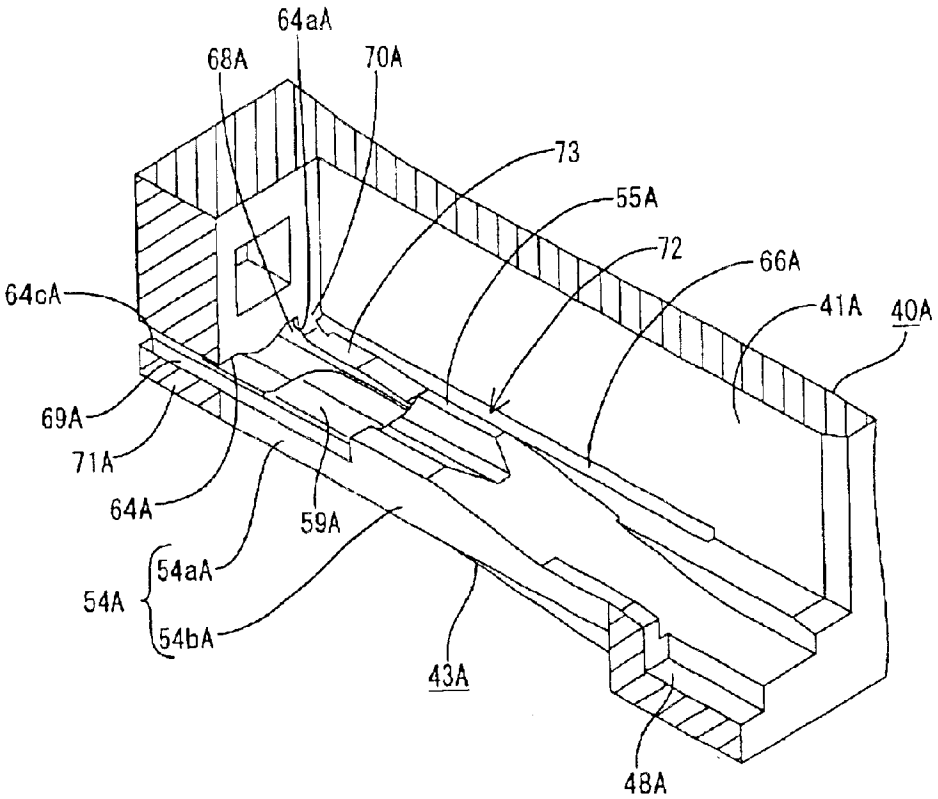
FIG. 18 is a perspective view partly in section of the female housing.
Figure 23:
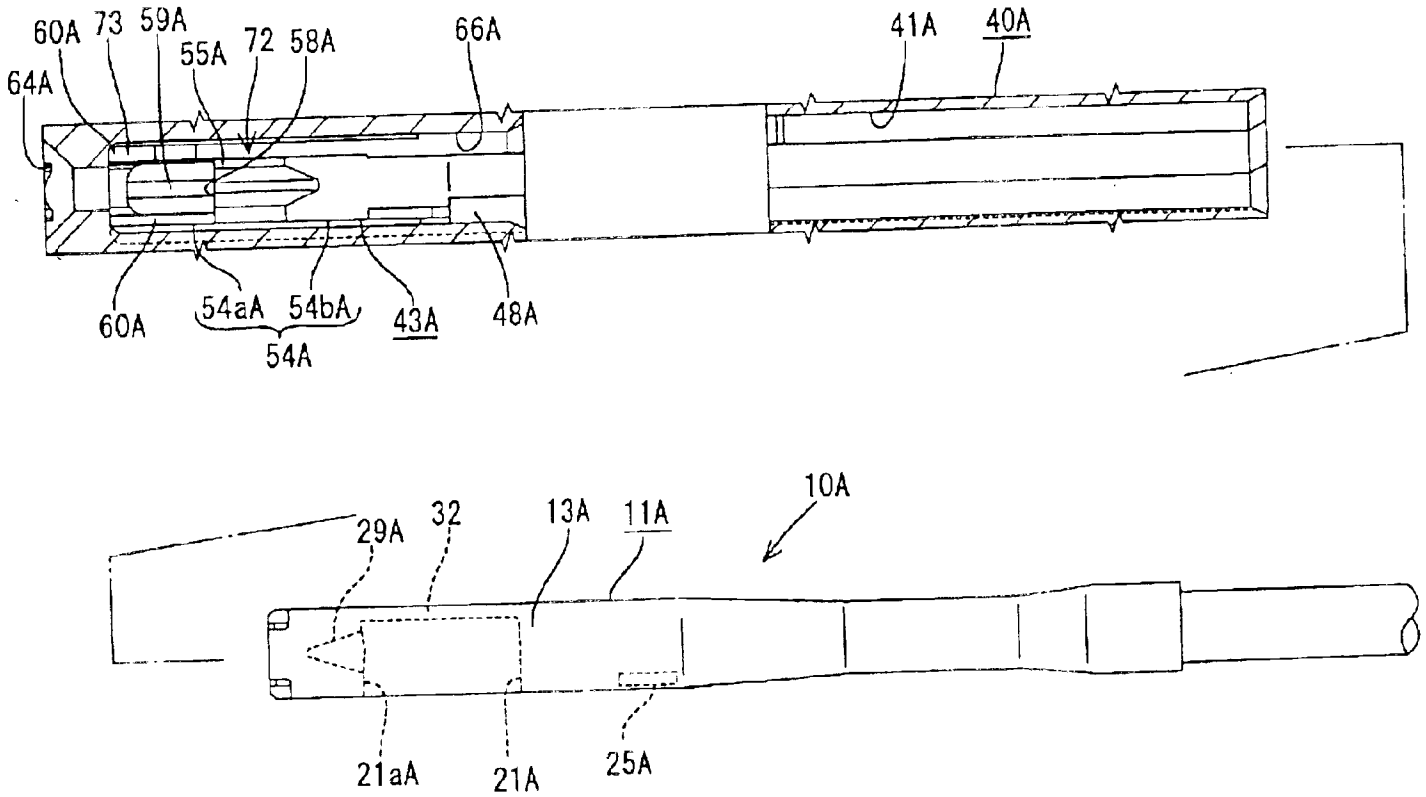
FIG. 23 is a plan view in section (the female housing is shown by a section along 23—23 of FIG. 16 and the female terminal fitting is shown by a plan view) showing the state before the female terminal fitting is inserted into the female housing.

The rear portion 54*b*A of the arm 54A slopes up to the front at its widthwise center, as shown in FIGS. 16 and 18, and the opposite sides thereof are parallel with the front portion 54*a*A. The side surface contour of the left branch 68A is formed as the mold is removed forward, and the opening 64A is formed in such a range as shown in FIG. 16. A front supporting portion 60A at the upper side of FIG. 23 is provided with a shake-preventing portion 73 that slopes up to the front, as shown in FIG. 18. A front end of the female terminal fitting 10 is closely fittable between a jutting portion 49A above and the shake-preventing portion 73 to prevent the female terminal fitting 10A from shaking. A maneuverable groove 59A is narrower than that of the first embodiment (see FIG. 1) and is arcuate, as shown in FIG. 16. The upper surface of the arm 54A is lower than that of the first embodiment (see FIG. 1), and the height of the fastening projection 55A is made larger accordingly. A stabilizer-inserting groove 48A is at the left end in FIG. 17 and conforms with the shape of the female terminal fitting 10A, and a restricting portion 50A is at a right-upper position of the peripheral edge of the rear end of the cavity 41A in FIG. 17.

Figure 24:
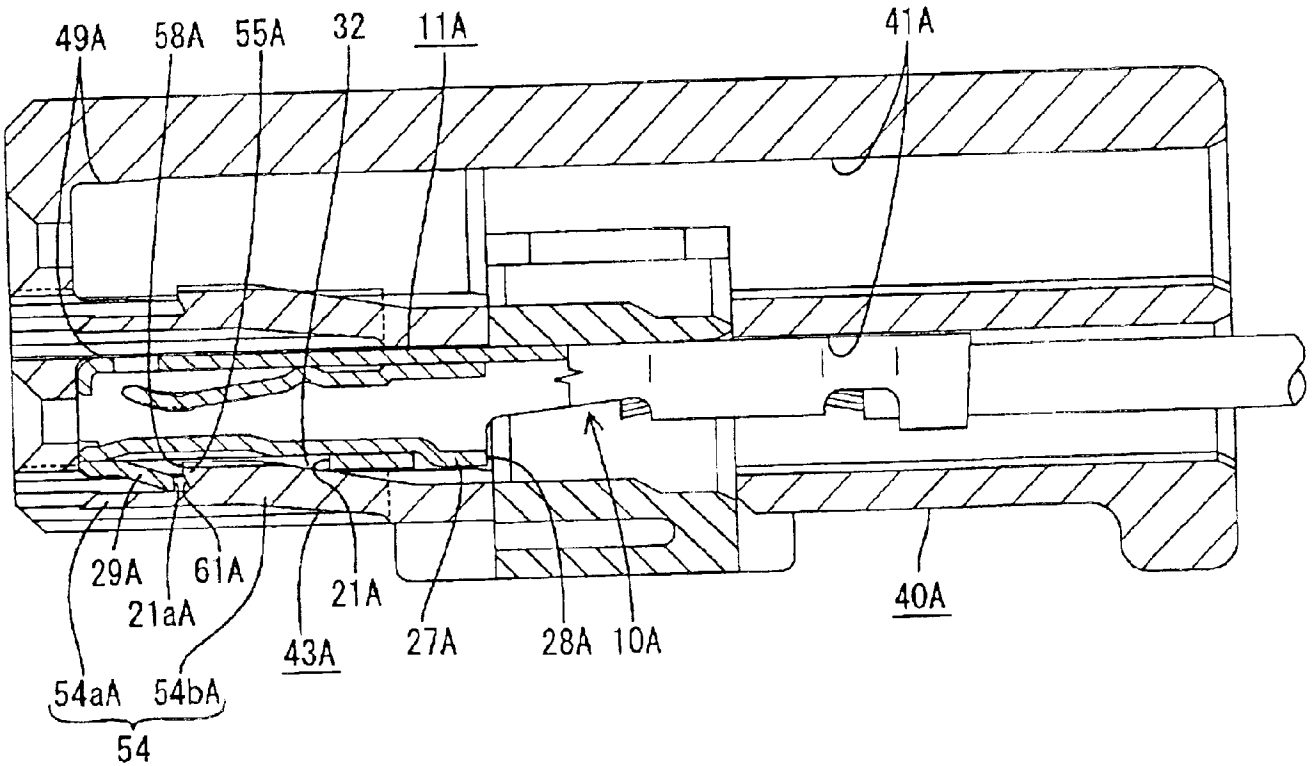
FIG. 24 is a side view in section similar to FIG. 22, but showing a state where the female terminal fitting is inserted in the female housing.
Figure 25:
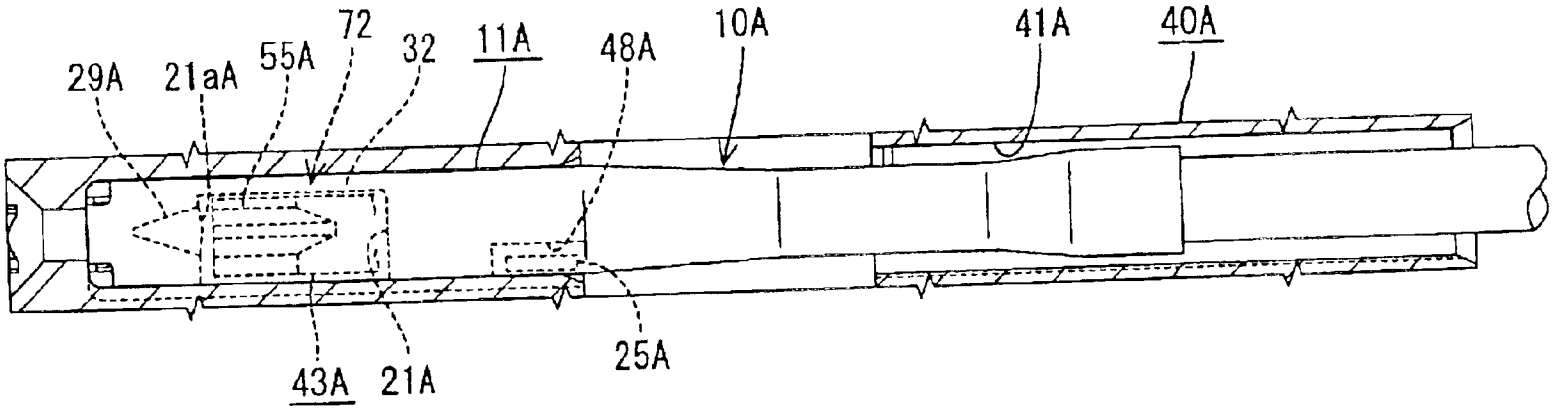
FIG. 25 is a plan view in section similar to FIG. 23, but showing the state where the female terminal fitting is inserted in the female housing.
Figure 26:
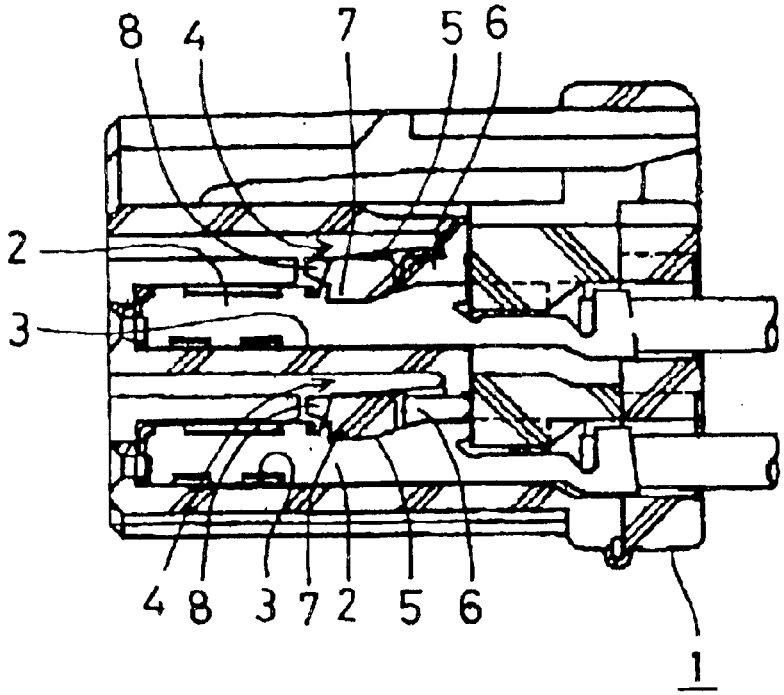
FIG. 26 PRIOR ART
FIG. 26 is a section of a prior art connector.

The connector is assembled by inserting the female terminal fitting 10 to a proper depth in the cavity 41A. Thus, the locking projection 29A enters the maneuverable groove 59A and the fastening projection 55A of the lock 43A enters the cut-away portion 21A. As a result, the locking surface 58A and an extended locking surface 61A engage a front cut end surface 21*a*A, as shown in FIGS. 24 and 25. At this time, the reinforcing piece 32 that couples the front and rear portions 17*a*A, 17*b*A of the outer wall 17A escapes into the escaping space 72 at the side of the fastening projection 55A. If the female terminal fitting 10A should be inserted into the female housing 40 shown in the first embodiment, the lock 43 cannot be restored because the fastening projection 55 of the lock 43 interferes with the reinforcing piece 32 (see FIG. 13). However, the escaping space 72 is formed at the side of the fastening projection 55A in this embodiment. Therefore, interference with the reinforcing piece 32 can be avoided and the lock 43A can be restored even if the female terminal fitting 10A has the reinforcing piece 32 to enhance strength. In other words, the female terminal fitting 10A for the female housing 40A is strong in spite of miniaturization.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Even if the female terminal fitting shown in the first embodiment is accommodated in the female housing of the second embodiment, the lock can be restored without interfering with the female terminal fitting.

The front end portion of the lock is connected at two positions to side surfaces of the opening in the foregoing embodiments. However, the front of the lock may be connected at one, three or more positions with the surfaces of the opening according to the invention. For example, the front ends of the two branches 68, 69 may be connected with the side surfaces 64*b*, 64*c* and may also be connected with the upper surface 64*a* of the opening 64. The front end of the lock is forked in the foregoing embodiments, but is not necessarily required to be forked according to the present invention.

The side surfaces of the opening connected with the lock are vertical in the foregoing embodiments. However, they may be slightly inclined with respect to vertical direction or curved according to the present invention.

The female terminal fitting has the locking projection in the foregoing embodiments. However, connectors with female terminal fittings that have no locking projection also are embraced by the present invention.

A female connector with female terminal fittings is described in the foregoing embodiments. However, the invention also is applicable to male connectors with male terminal fittings accommodated in a male housing.

What is claimed is:

1. A connector, comprising a housing with opposite front and rear ends, a front wall being formed at the front end and at least one cavity extending forwardly into the rear end of the housing for receiving a terminal fitting, a tab insertion hole extending through the front wall and communicating with the cavity, and a resiliently deflectable lock in the cavity, the lock having a locking surface spaced rearwardly from the front wall and projecting into the cavity and configured for locking the terminal fitting in the cavity, a deformation permitting space formed in the housing adjacent a side of the lock opposite the cavity;

the housing being formed with an opening in the front wall spaced below the tab insertion hole and communicating with portions of the cavity forward of the locking surface;

the lock being supported at two opposed ends including a rear end rearward of the locking surface; and the lock having branches projecting more forward than the locking surface and connected with the front wall adjacent the opening for supporting a front end of the lock, a jig introducing groove between the branches of the lock for guiding a jig onto a surface of the lock forward of the locking surface and facing into the cavity.

2. The connector of claim 1, wherein the branches are connected with a pair of opposed facing side surfaces at the opening.

3. The connector of claim 1, wherein portions of the lock projecting more forward than the locking surface have a maneuverable groove which is substantially open forward and is maneuverable by a disengagement jig (J) to deform the lock.

4. The connector of claim 3, wherein a locking projection projecting from the terminal fitting is insertable into the maneuverable groove, and the locking surface has an extended part extended to a rear end of the maneuverable groove so that the extended part of the locking surface is engageable with the locking projection for locking.

5. The connector of claim 3, wherein the lock is separated over at least part of its longitudinal extension from side walls of the cavity by at least one recess.

6. The connector of claim 3, wherein portions of the lock facing into the deformation permitting space are free of jig engaging structures.

7. The connector of claim 6, wherein part of the opening communicates with the deformation permitting space.

8. The connector of claim 6, wherein portions of the lock facing the jig introducing groove define a slanted guide surface aligned for guiding a jig onto the maneuverable groove.

9. The connector of claim 1, wherein portions of the lock facing into the deformation permitting space are free of jig engaging structures.

* * * * *